US011231209B2

(12) United States Patent
Cavalleri et al.

(10) Patent No.: US 11,231,209 B2
(45) Date of Patent: Jan. 25, 2022

(54) REFRIGERATION PLANT WITH MULTIPLE EVAPORATION LEVELS AND METHOD OF MANAGING SUCH A PLANT

(71) Applicant: EPTA S.p.A., Milan (IT)

(72) Inventors: Paolo Cavalleri, Milan (IT); Mario De Bona, Milan (IT); Daniele Mazzola, Milan (IT)

(73) Assignee: EPTA S.P.A., Milan (IT)

( * ) Notice: Subject to any disclaimer, the term of this patent is extended or adjusted under 35 U.S.C. 154(b) by 142 days.

(21) Appl. No.: 16/301,231

(22) PCT Filed: May 16, 2017

(86) PCT No.: PCT/IB2017/052873

§ 371 (c)(1),
(2) Date: Nov. 13, 2018

(87) PCT Pub. No.: WO2017/199167

PCT Pub. Date: Nov. 23, 2017

(65) Prior Publication Data

US 2019/0203980 A1 Jul. 4, 2019

(30) Foreign Application Priority Data

May 16, 2016 (IT) ..... 102016000049985

(51) Int. Cl.
*F25B 5/02* (2006.01)
*F25B 49/02* (2006.01)
(Continued)

(52) U.S. Cl.
CPC ..... *F25B 5/02* (2013.01); *F25B 1/10* (2013.01); *F25B 5/00* (2013.01); *F25B 41/20* (2021.01);
(Continued)

(58) Field of Classification Search
CPC .. F25B 41/04; F25B 5/02; F25B 49/02; F25B 1/10; F25B 5/00; F25B 2400/13;
(Continued)

(56) References Cited

U.S. PATENT DOCUMENTS 3,797,265 A * 3/1974 Garland ..... F25B 45/00 62/174
5,056,329 A * 10/1991 Wilkinson ..... F25B 9/006 62/197
(Continued)

FOREIGN PATENT DOCUMENTS

EP 1876402 A2 * 1/2008 ..... F25B 30/02
EP 2754978 * 7/2014
(Continued)

OTHER PUBLICATIONS

International Search Report and Written Opinion for PCT/IB2017/052873 dated Aug. 10, 2017.

*Primary Examiner* — Frantz F Jules
*Assistant Examiner* — Martha Tadesse
(74) *Attorney, Agent, or Firm* — Thomas|Horstemeyer LLP

(57) ABSTRACT

A refrigeration plant with multiple evaporation levels, operating according to a vapour compression cycle and including a circuit having a high-pressure branch HP, wherein is arranged at least one heat exchanger, and two or more low-pressure branches, each of which operates at a different evaporation level to serve users having different refrigeration requirements. In each of the low-pressure branches the plant comprises an expansion device, at least one evaporator and a compressor group. At least one evaporator of each low-pressure branch is connected directly to the high-pressure branch. At least a first low-pressure branch comprises a liquid separator fluidically connected: to the evaporator outlet to collect the liquid exiting the evaporator when
(Continued)

operating in overfeeding conditions; and to the intake of the compressor group. Such liquid separator is fluidically connected to a second low-pressure branch upstream of the expansion device of such second low-pressure branch through a first connection duct.

29 Claims, 12 Drawing Sheets

(51) Int. Cl.
*F25B 5/00* (2006.01)
*F25B 1/10* (2006.01)
*F25B 41/20* (2021.01)

(52) U.S. Cl.
CPC ..... *F25B 49/02* (2013.01); *F25B 2400/075* (2013.01); *F25B 2400/13* (2013.01); *F25B 2400/23* (2013.01); *F25B 2500/28* (2013.01); *F25B 2600/2515* (2013.01); *F25B 2700/04* (2013.01)

(58) Field of Classification Search
CPC ..... F25B 2500/28; F25B 2700/04; F25B 2400/075; F25B 2400/23; F25B 43/00; F25B 9/008; F25B 2600/2515; F25B 2400/0751
See application file for complete search history.

(56) References Cited

U.S. PATENT DOCUMENTS 6,032,473 A * 3/2000 Morimoto ..... F25B 41/20 62/205
6,202,486 B1 * 3/2001 Kemp ..... G01F 23/246 73/295
7,216,505 B2 * 5/2007 Braz ..... F25B 5/00 62/498
9,625,181 B2 * 4/2017 Kim ..... F25B 1/00
2002/0069654 A1 * 6/2002 Doi ..... F25D 17/065 62/199
2005/0044880 A1 * 3/2005 Braz ..... F25B 1/10 62/498
2006/0032267 A1 * 2/2006 Kamimura ..... F25B 1/10 62/498
2011/0100040 A1 * 5/2011 Bush ..... F25B 1/10 62/149
2012/0318006 A1 * 12/2012 Liu ..... F25B 41/22 62/80
2014/0352343 A1 * 12/2014 Hinde ..... F25B 47/022 62/277
2016/0356537 A1 * 12/2016 Chae ..... F25B 1/10

FOREIGN PATENT DOCUMENTS

GB 2405688 A * 3/2005 ..... F25B 47/022
WO WO-2012040864 A1 * 4/2012 ..... F25B 41/39
WO WO-2012168544 A1 * 12/2012 ..... F25B 9/008
WO 2016117946 A1 7/2016

* cited by examiner

REFRIGERATION PLANT WITH MULTIPLE EVAPORATION LEVELS AND METHOD OF MANAGING SUCH A PLANT

CROSS-REFERENCE TO RELATED APPLICATION

This application is the 35 U.S.C. § 371 national stage application of PCT Application No. PCT/IB2017/052873, filed May 16, 2017, where the PCT claims the priority to and benefit of Italian Patent Application No. 102016000049985, filed May 16, 2016, both of which are herein incorporated by reference in their entireties.

FIELD OF APPLICATION

This invention relates to a refrigeration plant with multiple evaporation levels and a method of managing such a plant.

The refrigeration plant and the managing method according to the invention find particular application in the commercial refrigeration field. The plant can be of the booster or non-booster type.

STATE OF THE ART

In the field of commercial refrigeration, the types of refrigeration users can be distinguished according to the evaporation temperature, which varies from user to user depending on the products to be refrigerated in it. For example, a counter for fruit and vegetable products is a user that needs an evaporation temperature generally higher with respect to a counter for dairy products or a meat counter, and a counter for frozen foods is a user that needs an evaporation temperature generally lower than a dairy or meat counter.

Generally, based on the temperature of the refrigeration air, two main types of users can be distinguished:

- positive temperature users, i.e., with evaporation temperature between −10° C. and 0° C. and air temperature >0° C.; and
- negative temperature users, i.e., with evaporation temperature between −40° C. and −20° C. and air temperature <0° C.

Usually these two types of users are supplied by two separate plant systems, each one defined by its own refrigerant distribution plant and its own cooling station.

There are also plant solutions in which these two types of users are fed by a single plant system and a single cooling station. In this case, one speaks of refrigeration plants with two or more evaporation levels. Such plant solutions allow feeding with a single plant system users at different evaporation temperatures, and in particular users both at negative temperature and at positive temperature. Such plant solutions are characterised in particular by the use of the same refrigerant fluid, in common for all evaporation levels.

When, in a plant with two or more evaporation levels, the compressors of a lower evaporation level discharge into the intake of the compressors of a higher evaporation level (i.e., the compressors of at least two levels are connected in series), it is called a booster system.

When, in a plant with two or more evaporation levels, the compressors of a lower evaporation level discharge into the same branch of the compressors of a higher evaporation level (i.e., the compressors of at least two levels are connected in parallel), it is called a non-booster system.

In a conventional direct-expansion refrigeration plant with at least two different evaporation levels, various techniques are used to maintain a degree of superheating at the outlet of the evaporators of the users. This means that, with an appropriate adjustment or design, the refrigerant exiting from the evaporator of the users has a higher temperature than the saturated evaporation temperature and therefore has the characteristics of a superheated gas with no trace of liquid. This degree of superheating is required to avoid a return of refrigerant in the liquid phase in the intake to the compressors of the cooling station, which would damage the compressor, reducing its efficiency and useful life. For this reason, in conventional systems with two evaporation levels and direct expansion, the superheating at the users is maintained and is of great importance for the reliability of the system.

The presence of superheating is, however, a cause of inefficiency because it reduces the coefficient of heat exchange of a part of the evaporator surface. Moreover, the presence of superheating has an adverse effect on the raising of the intake temperature to the compressors and consequently on raising the discharge temperature.

In direct expansion systems, the elimination of superheating is a technique used in particular in "flooded evaporator" plants. The fluid refrigerant in liquid form in the evaporators undergoes a partial phase transition to then return to an accumulation tank where the gaseous part is sucked towards the compressors. However, such systems require a specific design of the entire plant, of the evaporator components, of the oil recovery system and renunciation of control of the distribution of refrigerant by means of thermostatic valve. For these reasons, flooded evaporator systems are scarcely used in commercial refrigeration.

Another proposed technique, but more complex and costly, for reducing or eliminating superheating at the users involves the use of a component constituted by a liquid ejector. The use of this component allows eliminating the liquid through its movement from the phase separator to the liquid receiver, where it is made available again to the line feeding the users. This device is proposed for applications in booster plants using CO2, for example, as a refrigerant, that is trans-critical booster plants. The use of such a device usually also requires systems with parallel compression. Attached FIG. 1 illustrates a conceptual layout of a trans-critical circuit with application of the liquid ejector and flooding of the higher temperature users.

Other systems that use the flooded evaporator technique are indirect expansion plants, called "pumped" systems.

However, such systems involve much higher costs and plant complexity than direct expansion systems, since they require large refrigerant accumulation tanks and additional components such as circulators and refrigerant movement pumps. These circulators must be installed respecting particular differences of height level with respect to the accumulation tanks to avoid cavitation of the refrigerant with severe constraints on the versatility of installation. Attached FIG. 2 illustrates a conceptual layout of a pumped circuit. Given the high cost and high installation constraints, pumped systems are only used in industrial refrigeration and rarely in commercial refrigeration, except on very large plants.

An example of highly efficient pumped plant is disclosed in the patent application US2005/0044880 wherein an accumulation tank, a relative recirculation pump and a relative group of vapour compression are associated to each evaporation level. In such plant each level of compression is served by a refrigerant fluid, which is at the maximum temperature useful to satisfy the relative refrigerating users. Such division in more evaporation levels allows optimizing the removal of flash gas (discarded gas) due to the pressure loss (and consequent lamination) between the different tanks, as well as the removal of the gas evaporated by the different users. In fact, said removal takes place by means of specific systems of vapor compression, each working at the relative evaporation level of the users and as a whole more efficient than a single compression operating at a only one evaporation level, necessarily linked to the user working at the worst conditions. The creation of such a system, characterized by several pressure levels, maximizes energy saving of the pumped plant, but exasperates the cost and the complexity thereof due the presence of at least one circulator, a tank and a set of compressors of each evaporation level. Moreover, the plant proposed in US2005/0044880 gets a lower level of reliability if compared to direct expansion plants previously described, due to the fact that the refrigeration efficacy is based not only on the working of the compressors, but also on the working of the circulators of each evaporation level. Such circulators, except further increase in cost and complexity, are provided in the plant without redundancy for reasons of cost and encumbrance. Such plant, even though it has a very high efficiency level, is not a solution applicable in a plant having the dimensions typical of the commercial refrigeration for reasons of cost, complexity and reliability.

Therefore, there is a need in commercial refrigeration for refrigeration plants with two or more evaporation levels, which allows improving the efficiency of heat exchange at the evaporators the exchange surface being equal by flooding the evaporators, while, at the same time, avoiding negative effects on the compressors, and which are simpler to construct than those known to date.

PRESENTATION OF THE INVENTION

Therefore, the purpose of this invention is to eliminate or at least mitigate the drawbacks of prior art mentioned above, by providing a refrigeration plant with multiple evaporation levels that allows exploiting the technique of overfeeding one or more evaporators in order to improve the efficiency of heat exchange while avoiding negative effects on the compressors and that is simpler to construct than the known systems.

A further purpose of this invention is to make available a refrigeration plant with multiple evaporation levels that is simple to construct with plant costs comparable to conventional plants.

A further purpose of this invention is to make available a refrigeration plant with multiple evaporation levels that is reliable and operationally easy to manage.

A further purpose of this invention is to make available a method of managing a refrigeration plant with multiple evaporation levels that envisages the possibility of exploiting the technique of overfeeding one or more evaporators in order to improve the efficiency of heat exchange without negative effects on the compressor and that is operationally simple to implement.

BRIEF DESCRIPTION OF THE DRAWINGS

The technical characteristics of the invention, according to the above-mentioned purposes, can be clearly understood from the claims listed below and its advantages will become more apparent from the detailed description that follows, made with reference to the attached drawings, which show one or more purely exemplary and non-limiting embodiments wherein:

The elements, or parts of elements, in common between the embodiments described below will be indicated with the same reference numbers.

DETAILED DESCRIPTION

This invention relates to a refrigeration plant with multiple evaporation levels and a method of managing such a plant.

For simplicity of explanation, the refrigeration plant will be described first, and then the managing method.

With reference to the attached figures, reference number 1 indicates, in its entirety, a refrigeration plant with multiple evaporation levels according to the invention.

The refrigeration plant 1 operates with a refrigerant according to a vapour compression cycle. The cycle can be either sub-critical or trans-critical. In particular, it is possible to use CO2 as a refrigerant.

According to a general embodiment of the invention, the plant 1 comprises a circuit 2 having:

- a high-pressure branch HP, in which is arranged at least one heat exchanger 10, which functions as a condenser or gas cooler according to whether the cycle is sub-critical or trans-critical and
- two or more low-pressure branches LP1, LP2, LP3, each of which operates at a different evaporation level to serve users having different refrigeration requirements.

"Evaporation level" means the pressure range within which—based on the design conditions—it is envisaged that the evaporator works depending on the type of users to be served.

For example, a low-pressure branch intended to serve one or more counters for fruit and vegetable products (users) will operate at a higher evaporation level than another low-pressure branch intended, instead, to serve one or more counters for dairy products (users) or one or more frozen food counters (users).

As illustrated in the attached figures, in each low-pressure branch LP1, LP2, LP3 the aforesaid plant comprises:

an expansion device 11', 11", 11'";

at least one evaporator 12', 12", 12'"; and a compressor group 13', 13", 13'".

Figure 1:
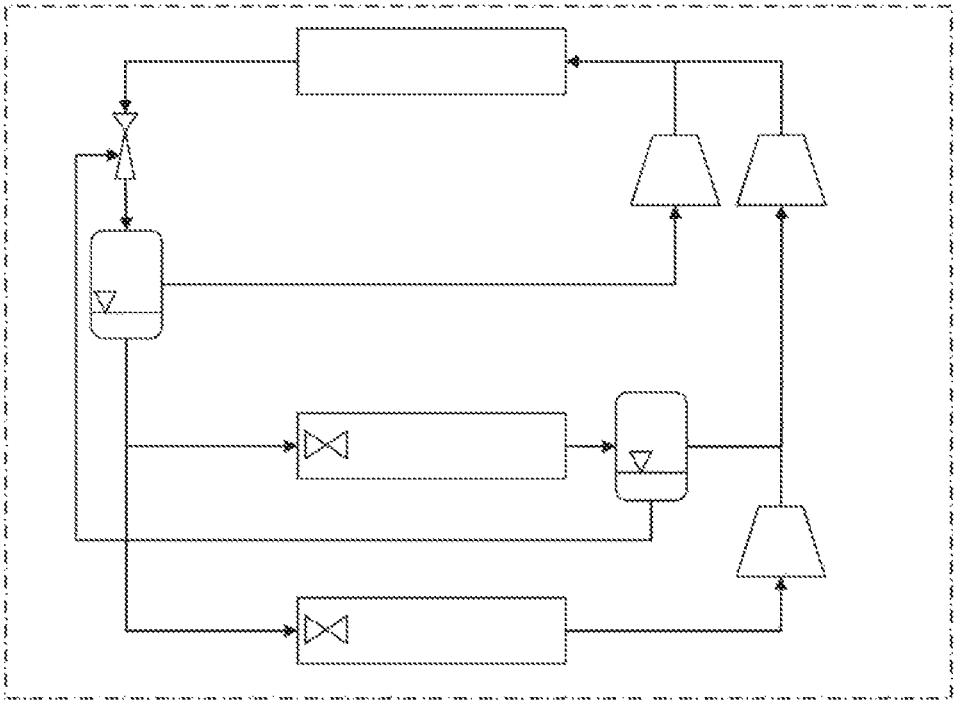
FIG. 1 shows a conceptual layout of a trans-critical circuit with two evaporation levels using a liquid ejector for recirculation upstream of the evaporation level of the liquid collected into a separator placed downstream of the evaporation level.
Figure 2:
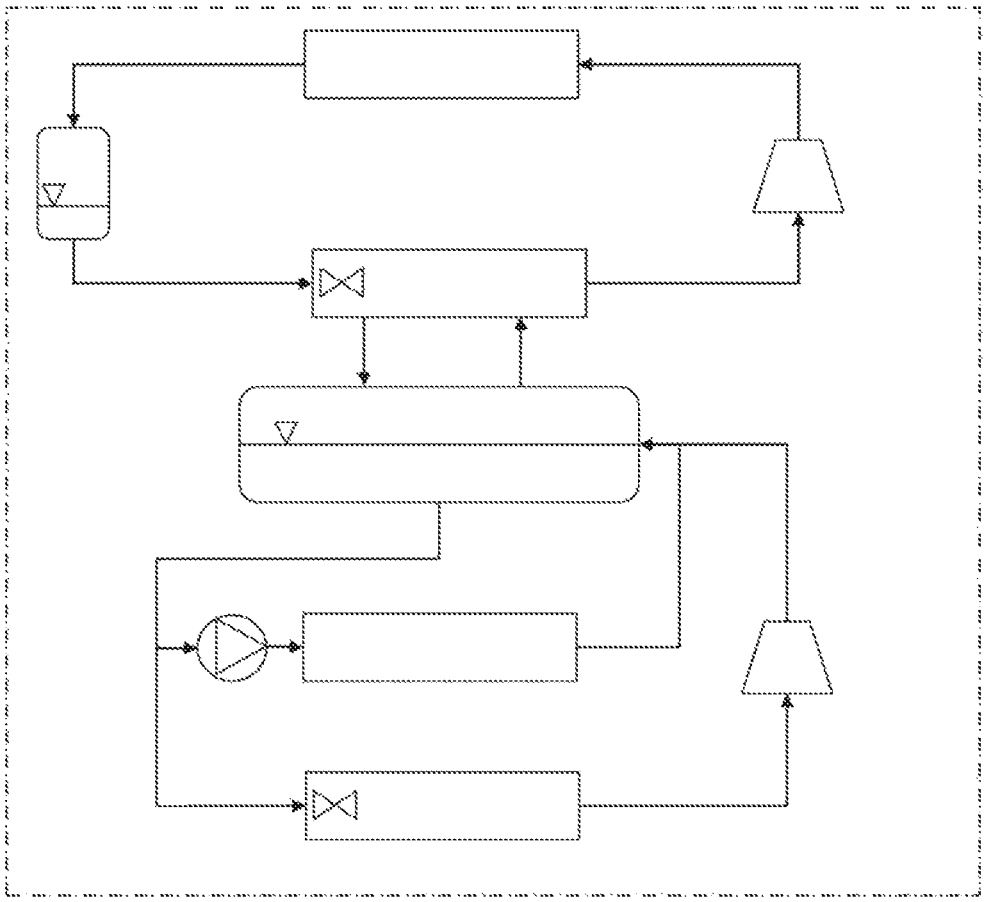
FIG. 2 shows a conceptual layout of a type "pumped" refrigeration system.
Figure 3A:
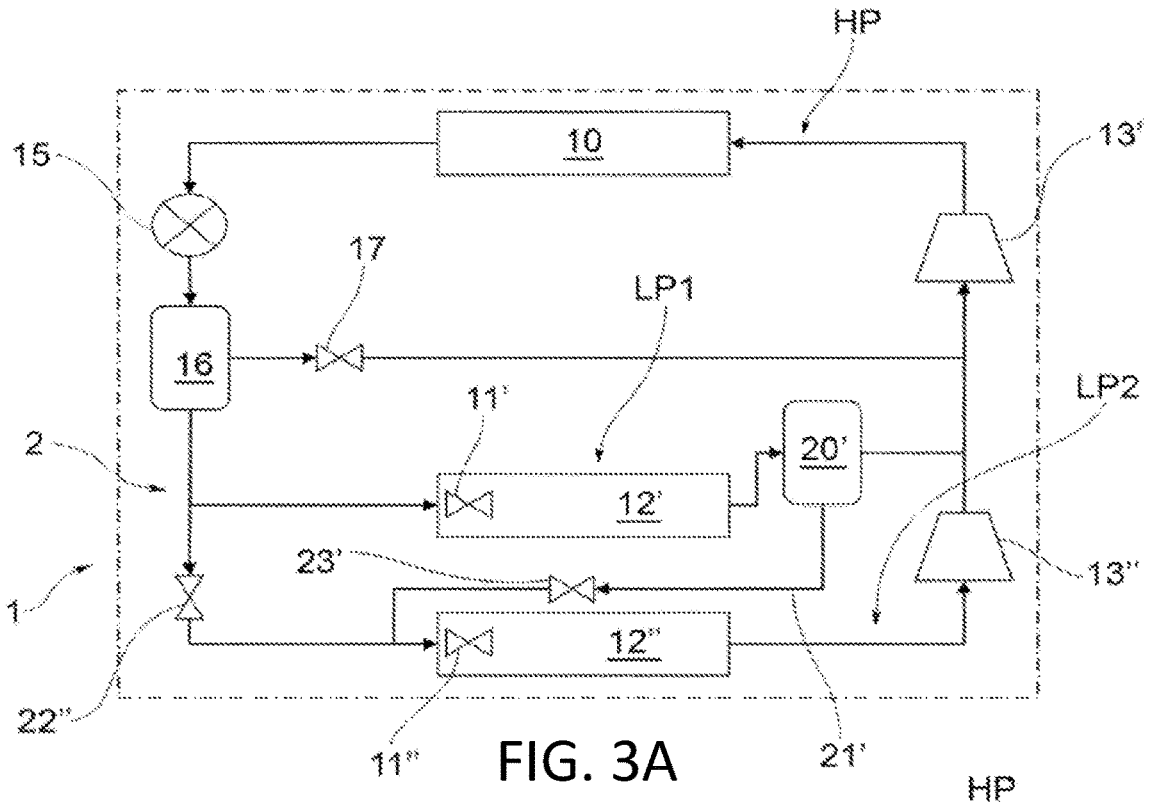
FIGS. 3A and 3B show a simplified diagram of a trans-critical refrigeration plant with two evaporation levels arranged in series, according to a first embodiment of this invention (FIG. 3A) and an alternate embodiment (FIG. 3B)
Figure 4:
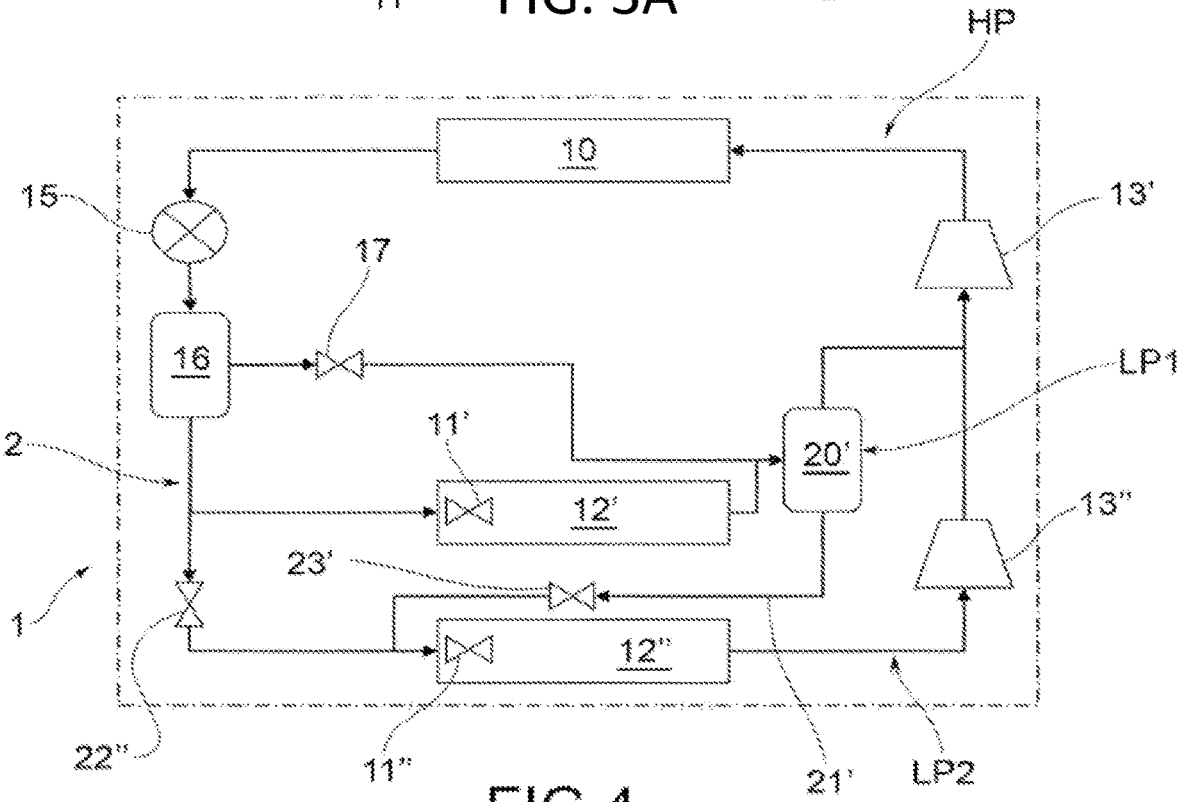
FIG. 4 shows a variant of the plant diagram of FIG. 3A that provides for the recovery of the flash-gas to the phase separator placed downstream of the higher evaporation level.

Said at least one evaporator of each low-pressure branch LP1, LP2, LP3 is connected directly to said high-pressure branch HP. Direct connection includes also the case in which there is the interposition of valve means, such as control or interception valves, as shown for example in the FIG. 3A and in the FIG. 14A, where one or two low-pressure branches are connected to the high-pressure branch HP by means of valve means 22' and 22".

This means that the refrigerant flows through the users only due to the pressure difference generated by the compressors. The expansion device, placed directly on the user, manages the direct expansion of the refrigerant inside the evaporator. In this way, the system, called "with direct expansion", does not need additional devices for moving the refrigerant, such as, for example, circulators or pumps, in order to correctly feed the refrigerating users and in general for its correct working.

Figure 15:
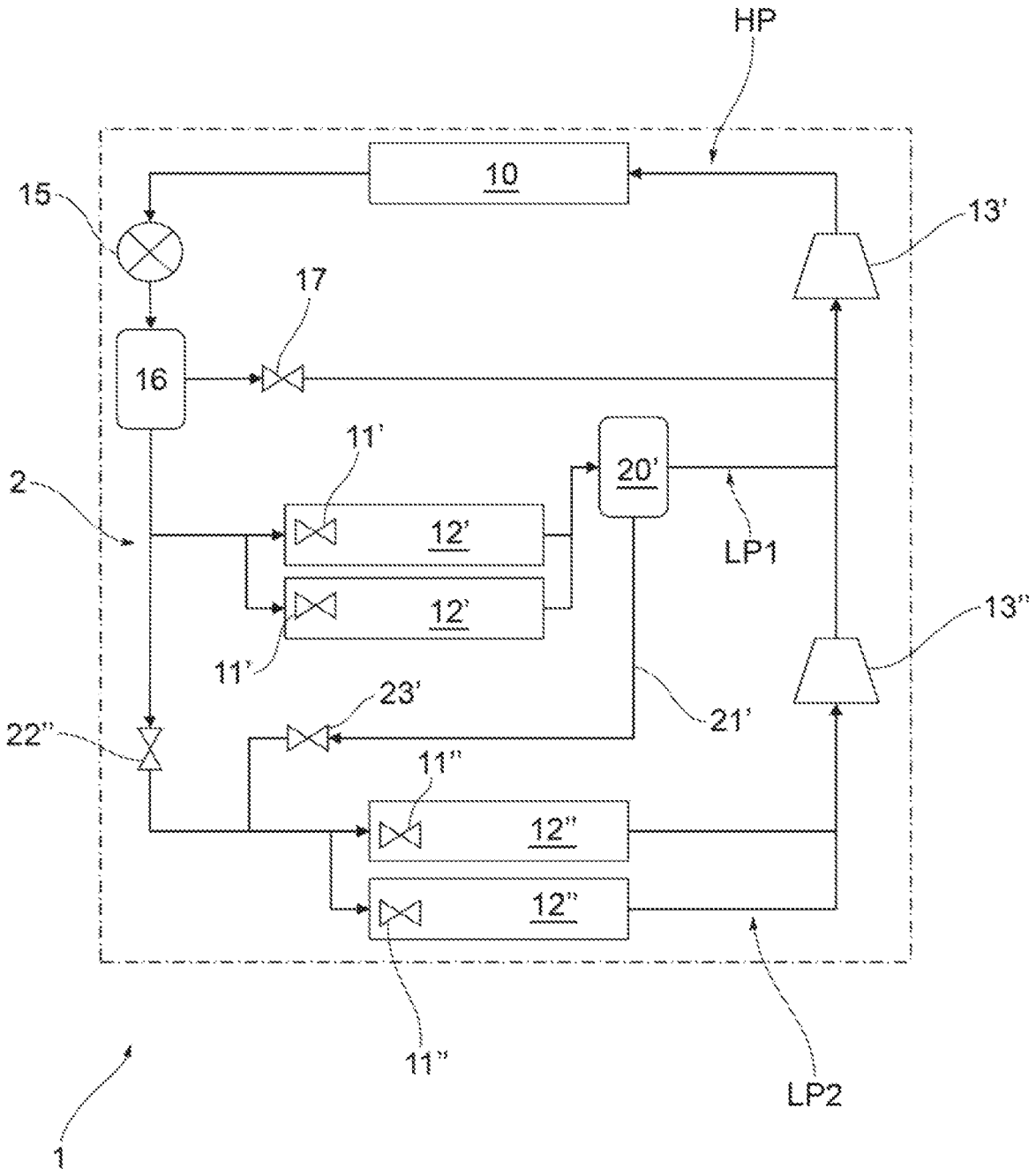
FIG. 15 shows a variant of the plant diagram of FIG. 3A, in which the two low pressure branches each have two evaporators in parallel.

As shown in FIG. 15, in one or more of said low-pressure branches, the single evaporator may be replaced by two or more evaporators connected in parallel, each evaporator having its own expansion device.

In the high-pressure branch, the heat exchanger 10 (condenser or gas cooler) can be replaced by two or more heat exchangers connected together in parallel or in series.

As illustrated in the attached figures, at least a first low-pressure branch LP1, operating at a first evaporation level, comprises a liquid separator 20' that is fluidically connected:

- to the evaporator outlet 12' of said first low-pressure branch LP1 to collect the liquid exiting the evaporator 12' in case the latter is operating in overfeeding conditions; and
- to the intake of the compressor group 13' of said first low-pressure branch LP1.

According to this configuration, in the case where the evaporator 12' is operating in overfeeding conditions (partially or totally flooded, i.e., without any degree of superheating in exiting) the intake of the liquid by the compressor group 13' is avoided.

"Overfeeding" means all situations in which liquid is present at the outlet of the evaporator. This therefore also includes the situation in which, even though the control system provides for a degree of superheating (low), there are traces of liquid present due to instrument imprecision at the outlet of the evaporator.

Preferably, as shown in FIG. 15, in the case in which a low-pressure branch has two or more evaporators connected in parallel, such evaporators are all connected in parallel to a same liquid separator 20'.

According to a first essential aspect of this invention, the aforesaid liquid separator 20' is not fluidically connected to the inlet of the evaporator of said first low-pressure branch LP1, but is fluidically connected to a second low-pressure branch LP2 of the circuit 2, operating at a second evaporation level lower than the first. The fluidic connection is made upstream of the expansion device 11" of this second low-pressure branch LP2 by means of a first connection duct 21'.

The absence of such fluidic connection of said liquid separator to the inlet of the evaporator of said first low-pressure branch avoids the refrigerant fluid the necessity of moving towards components of the circuit, which are at a pressure level higher than that of the evaporator. Consequently, it is not necessary to introduce components for increasing pressure, such as circulators, pumps or ejectors. Consequently, in the present invention, the refrigerant flow can be guaranteed only by the pressure difference generated by the compressors only, said refrigerant moving always towards components having lower pressure, up to the inlet of the same compressors According to a further essential aspect of this invention, the circuit 2 comprises first valve means 22",23' which are installed in the first connection duct 21' and in the second low-pressure branch LP2 and are controllable (preferably by an electronic control unit, not shown in the attached figures) in such a way that the aforesaid second low-pressure branch LP2 is fed alternately by the high-pressure branch HP or by the liquid separator 20' by means of the aforesaid first connection duct 21'.

Operationally, these first valve means 22", 23' are actuated to allow the feeding of the evaporator 12" of the second low-pressure branch LP2 with liquid coming from the liquid separator 20' of the first evaporation branch LP1 when the evaporator 12' of the first evaporation branch LP1 is made to operate in overfeeding conditions so as to discharge the liquid that is collected into the liquid separator 20'. The aforesaid first valve means 22", 23' are therefore installed in such a position that their actuation does not interrupt the connection of said first low-pressure branch LP1 with the high-pressure branch.

Advantageously, the evaporator of each low-pressure branch is equipped with all the devices suitable to change the operating conditions, i.e., to make the evaporator operate in superheating conditions at the outlet by adjusting the degree of superheating and to make the evaporator operate in overfeeding conditions. Such devices are, in themselves, well known to a person skilled in the field and will not be described here in detail.

Preferably, such devices suitable to modify the operating conditions of an evaporator comprise: —a regulation valve as expansion device at the inlet of the evaporator; —a pressure probe and a temperature probe placed at the evaporator outlet. The operating conditions are adjusted by acting on the opening of the expansion device upstream of the evaporator, according to a feedback control based on measurement of the pressure and temperature conditions at the evaporator outlet.

In extreme synthesis, as will be taken up again below when describing the method of managing the plant, this invention thus consists in collecting into a phase separator the liquid exiting from at least one evaporator, that is installed in a low-pressure branch of the circuit and is made to operate in conditions of overfeeding, and in feeding, with this liquid, the evaporator of at least one low pressure-branch operating at a lower refrigeration level.

As will be taken up below in describing the managing method, the regulation of the degree of superheating of each evaporator and the choice of possibly making it operate in overfeeding conditions is made according to a logic of reducing the power absorbed by the relative compressor group. In particular, the choice of operating in overfeeding conditions is made to improve the exploitation of the heat exchange surface of the evaporator so as to raise the evaporation temperature heat load being equal or so as to maintain the evaporation temperature constant in the case of increase of the heat load.

Thanks to the invention, it is possible to exploit the technique of overfeeding, avoiding the need to recycle, in the high-pressure branch, the liquid generated by the overfeeding, by instead making available, to an evaporator operating at a lower evaporation level, liquid with enthalpy lower than that supplied to the high-pressure branch. As will be taken up below, this is advantageous from the point of view of plant efficiency.

Thanks to the invention, all this can be achieved with plant solutions that are, as a whole, simple. In particular, there is no need for devices to recirculate the liquid in the high-pressure branch, such as ejectors or pumps. As will be taken up below, the use of recirculation devices in the high-pressure branch, in particular pumps, can be provided, but only and possibly as a safety device in the event of an excessive accumulation of liquid in the separator.

Below, the main advantages of this invention are listed.

A first advantage (in common with the solutions of the prior art) lies in the possibility of eliminating the inefficiency of the superheating at the outlet of the evaporator, allowing better use of the evaporator surface with the consequent possibility of increasing the evaporation temperature. The increase of the evaporation temperature brings with it several advantages such as the reduction of the energy consumption of the compressors.

The elimination of superheating also involves a decrease of the intake temperature of the compressors, which results in a decrease in the discharge temperature of the compressors. The decrease of the discharge temperature of the compressors allows mitigating various problems linked to the high discharge temperatures such as deterioration of the lubricant oil and of some parts of the compressor. The decrease in the discharge temperature and the increase in efficiency also lead to the reduction of the power to be disposed of into the high-pressure heat exchanger (condenser or gas cooler).

Another advantage (also in common with the solutions of the prior art) lies in the fact that, in any case, the presence of a liquid/vapour phase separator downstream of the evaporator increases the reliability of the system since it prevents the return of liquid to the compressors even in the event of failure of one of the expansion devices (understood as a combination of valves and pressure, temperature and control sensors) in the evaporators or in case of excessive return of liquid formed by the expansion of the flash gas. This elimination of the risk of liquid returning can lead to the simplification of the superheating control devices such as the injection of hot gas at the intake of the compressors and make superfluous the presence of systems such as anti-liquid bottles.

Thanks to the invention, unlike the prior art solutions, all of these advantages are, however, achievable with a simple plant layout that does not require the recirculation of excess liquid to the high-pressure branch. Furthermore, as already said, the discharge of the liquid generated by overfeeding to an evaporator operating at a lower refrigeration level provides further advantages in terms of efficiency of the system. In fact, it is possible to use a refrigerant with a lower level of enthalpy. This implies a greater enthalpy jump available to the users served by the low-pressure branch fed with such overfeeding liquid. The increase in the enthalpy jump available to such users reduces the refrigerant flowrate required by these same users. Consequently, at least limited to the low pressure branch affected by the feeding of this overfeeding liquid, there is a reduction of load losses, as well as a lower consumption of energy by the compressor group.

Preferably, as shown in the diagrams of FIGS. 3A and 4 to 12, said first valve means 22", 23' comprise: —a first valve 22" of connection between the high-pressure branch HP and the second low-pressure branch LP2; and—a second valve 23' installed on such first connection duct 21'.

According to a particularly preferred embodiment, the aforesaid first valve 22" is an on-off valve (in particular a solenoid valve), while the aforesaid second valve 23' is a non-return valve. This configuration significantly simplifies control. In particular, the non-return valve has an automatic behaviour and therefore does not require an active control by the control system.

Operationally, the feeding of the second low-pressure branch LP2 with the liquid collected into the separator 20' can be activated using the aforesaid valve means in the manner described below.

When the evaporator 12' of the first low-pressure branch LP1 is made to operate in overfeeding conditions, overfeeding liquid accumulates in the separator 20' of such first low-pressure branch LP1. At this point the first solenoid valve 22" is made to close. For example, the closure of this valve can be conditioned to the exceeding of a predetermined level of liquid in the separator 20'. The refrigerant request from the evaporator 12" of the second low-pressure branch LP2 lowers the pressure of the liquid line between the first solenoid valve 22" (closed) and the evaporator 12". When the pressure value falls below the pressure value of the separator 20', the second valve 23' (non-return valve) opens, feeding the evaporator 12" with the overfeeding liquid accumulated in the separator 20'. When the first solenoid valve 22" is made to open again (for example, if the level of liquid accumulated inside the separator 20' falls below a certain level), the pressure in the portion of liquid pipe that leads to the evaporator 12" from the second valve 23' (non-return valve), starts to rising again. The non-return valve 23' will close because of this pressure increase and the feeding of the evaporator 12" from the high-pressure branch HP will be restored.

Figure 3B:
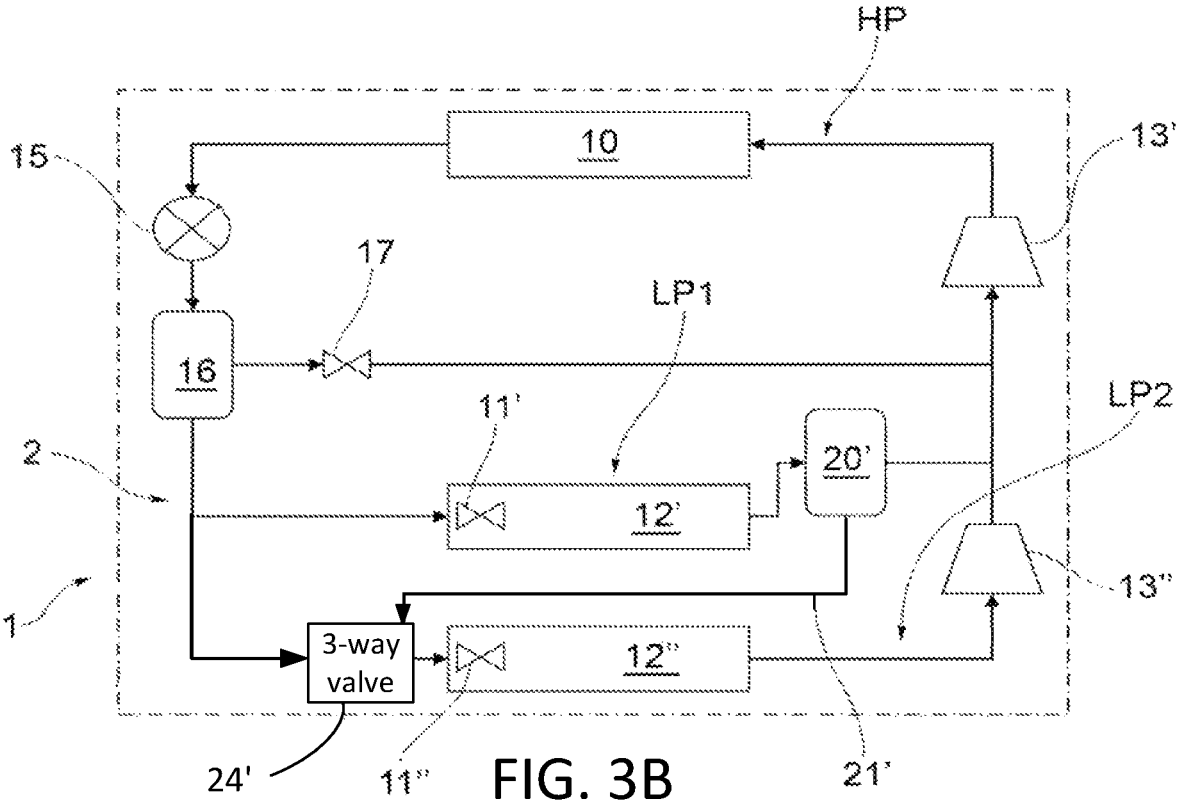
Figure 14A:
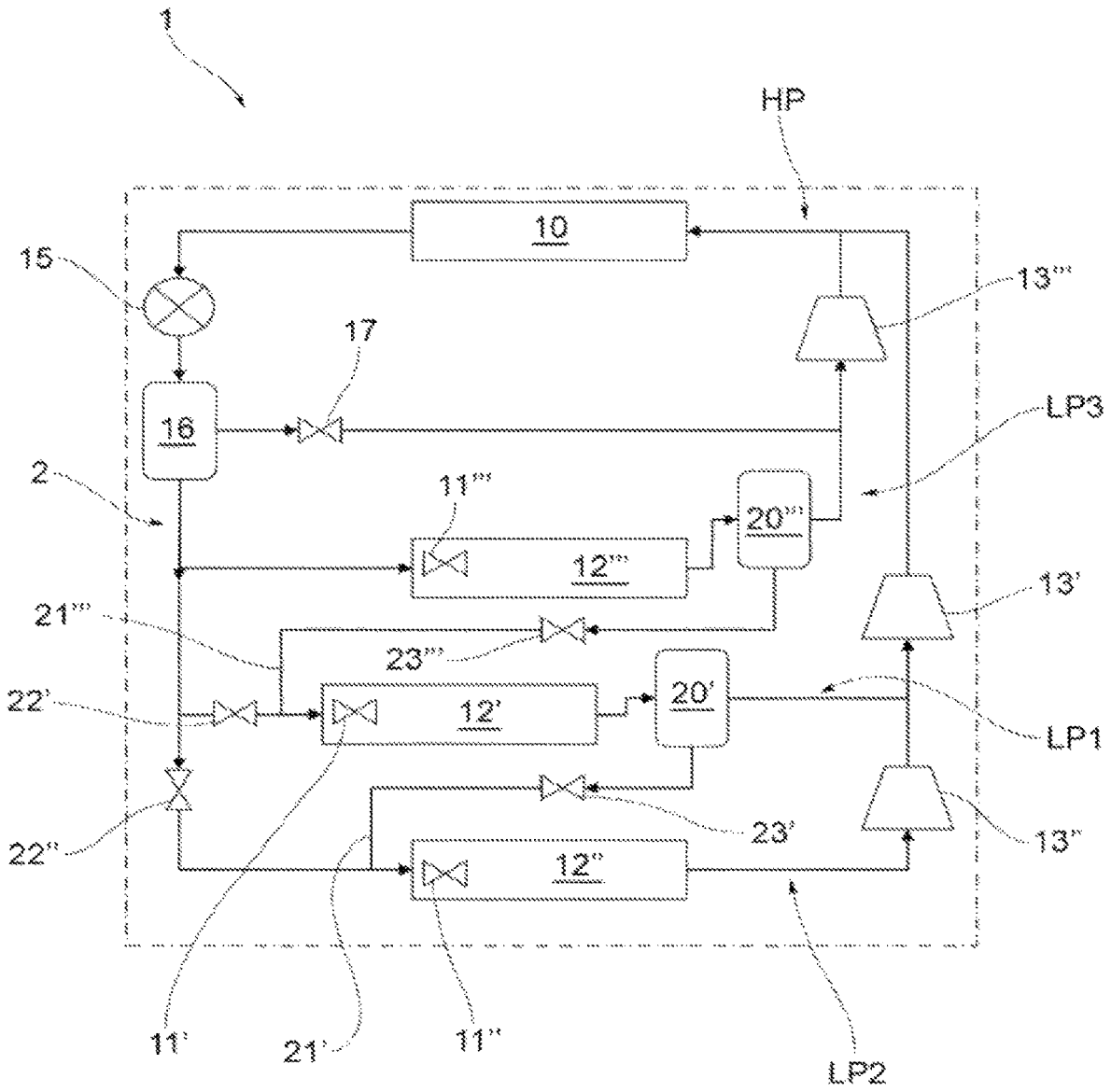
FIGS. 14A and 14B show variants of the plant diagram of FIG. 13.
Figure 14B:
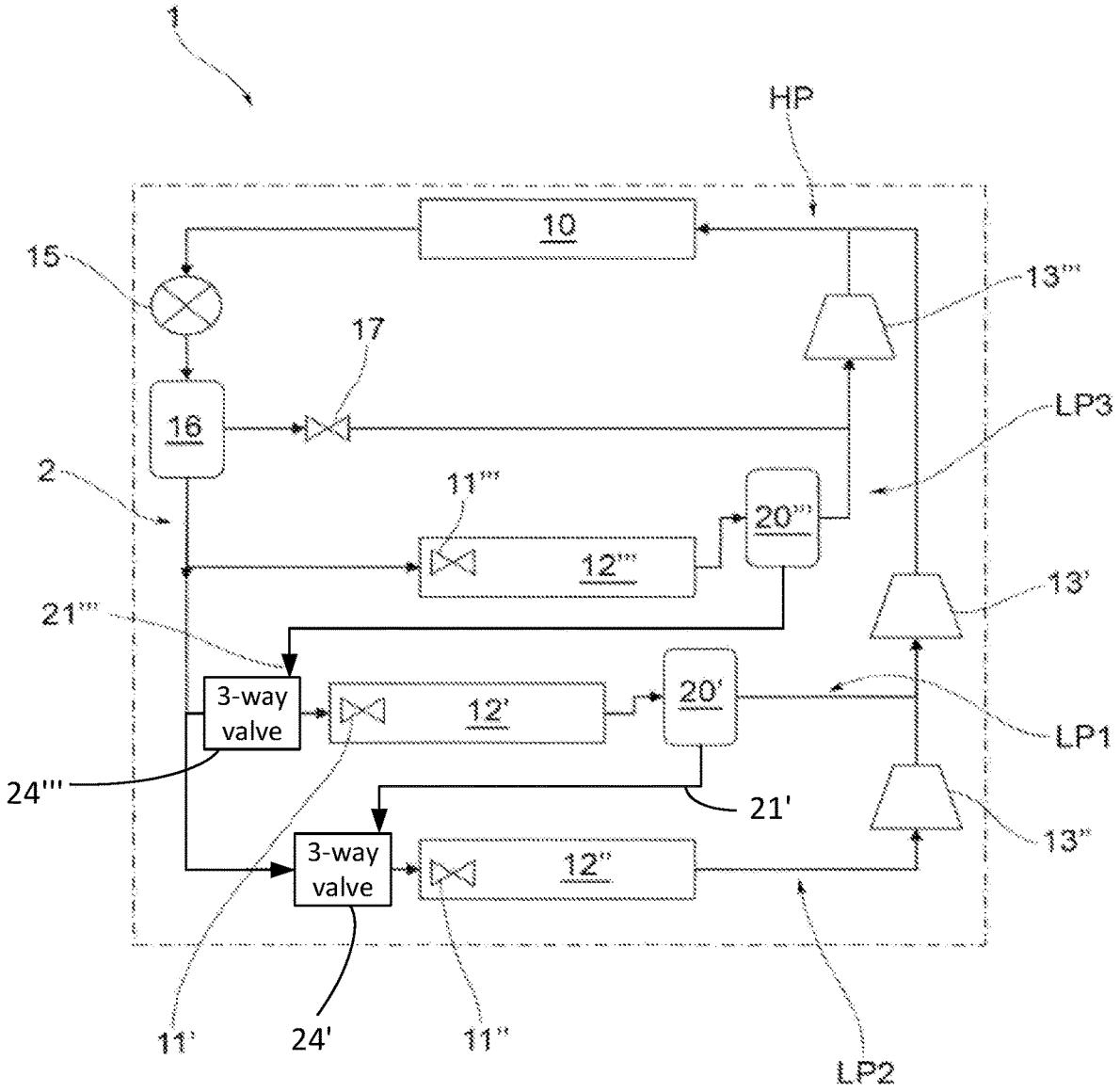

According to an alternative embodiment shown for example in FIGS. 3B and 14B, the aforesaid first valve means can be constituted by a three-way valve 24', which connects the second low-pressure branch LP2 alternately to the high-pressure branch HP and to the first connection duct 21'. Even in this case (not preferred), the control of the three-way valve will preferably be carried out as a function of the level of overfeeding liquid in the liquid separator.

For simplicity of explanation, the plant 1 according to the invention has been described so far considering only the presence of two low-pressure branches, LP1 and LP2. The diagrams of FIGS. 3A to 12 refer to this case. However, advantageously, the invention can also apply to the case in which two or more low-pressure branches LP1 and LP3 are made to operate in overfeeding conditions and the liquid collected at the outlet of the respective evaporators is used to feed one or more low-pressure branches operating at lower evaporation levels.

Figure 13:
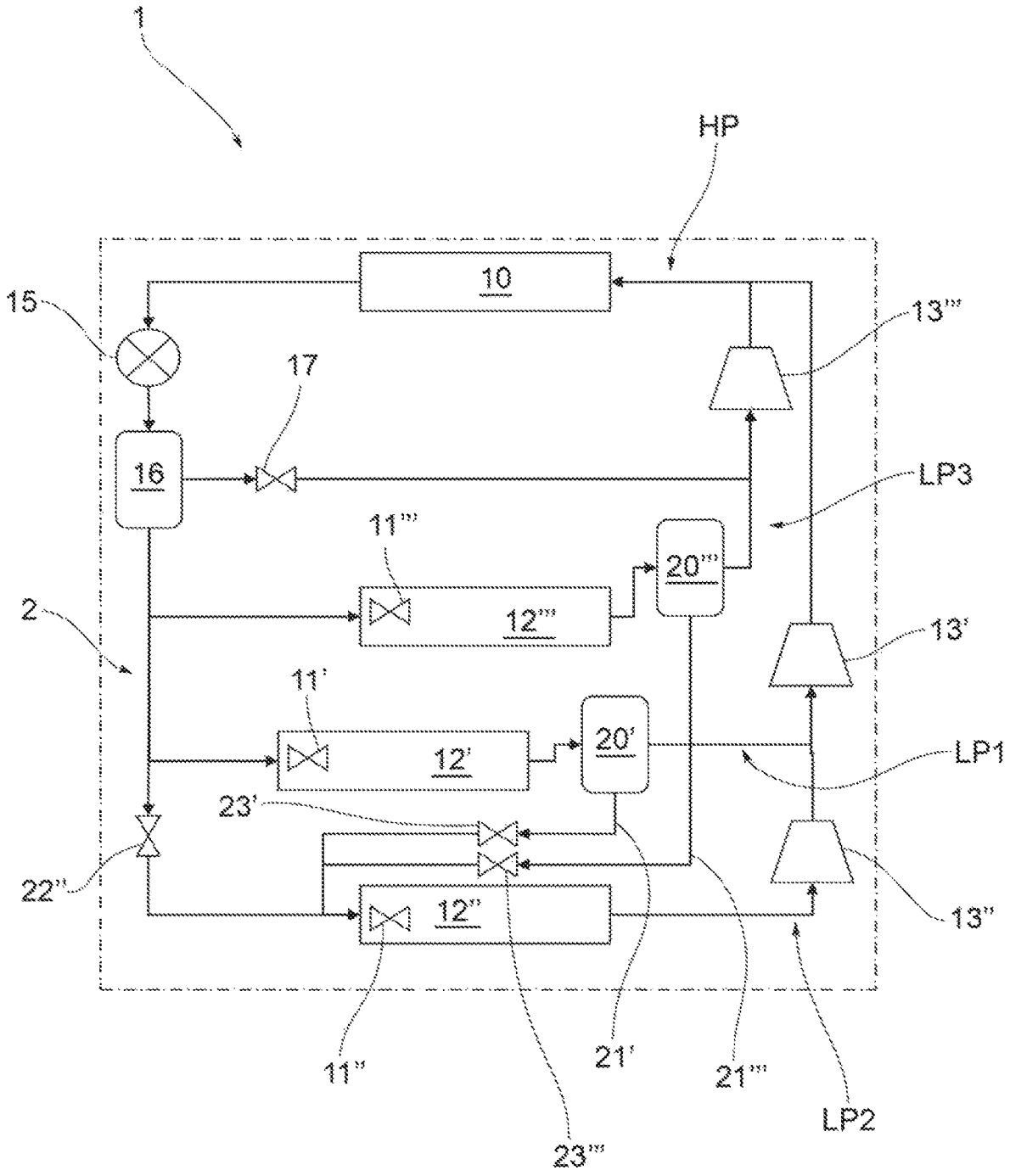
FIG. 13 shows a simplified diagram of a trans-critical refrigeration plant with three evaporation levels, two of which are arranged in parallel and one in series, according to a different embodiment of this invention.

As will be clarified in the continuation of the description, when two or more low-pressure branches are made to operate in overfeeding conditions, one can preferably provide two different plant diagrams:

- two or more different low-pressure branches LP1, LP3 are connected to the same low-pressure branch LP2 operating at a lower level in order to feed it with the overfeeding liquid generated by them, as shown for example in the scheme of FIG. 13; or
- three or more low pressure branches are connected together in cascade to allow the discharge in cascade of the overfeeding liquid, starting from the branch that operates at the highest evaporation level up to the branch that operates at the lowest evaporation level, as shown for example in the diagram of FIG. 14A.

Below, the plant 1 is described in greater detail by referring to two examples relating to the two different diagrams presented above. For simplicity of explanation, the description will be made referring to only three different low-pressure branches LP1, LP2 and LP3, but it can also be extended to a greater number of low-pressures branches involved.

According to the embodiments illustrated in FIGS. 13 and 14A, the aforesaid circuit 2 comprises at least a third low-pressure branch LP3 that operates at a third evaporation level higher than the second evaporation level.

This third low-pressure branch LP3 comprises its own liquid separator 20''' fluidically connected:

- to the outlet of the evaporator 12''' of said third low-pressure branch LP3 to collect the liquid exiting the evaporator 12''' in case the latter is operating in overfeeding conditions; and
- to the intake of the compressor group 13''' of said third low-pressure branch LP3.

According to the diagram of FIG. 13, the liquid separator 20''' of said third low-pressure branch LP3 is fluidically connected to the second low-pressure branch LP2 operating at said second evaporation level, which is lower than both the first and the third evaporation level. The connection is made upstream of the expansion device 11'' of this second low-pressure branch LP2 by means of a second connection duct 21'''.

The third low-pressure branch LP3 discharges the overfeeding liquid into the same low-pressure branch LP2 to which the first low-pressure branch LP1 is connected, and can operate indifferently at a lower or higher evaporation level than that of the first low-pressure branch LP1.

According to the diagram of FIG. 13, the circuit 2 comprises second valve means 22'', 23''' that are installed on the second connection duct 21''' and on the second low-pressure branch LP2 and are controllable in such a way that the second low-pressure branch LP2 is fed alternately by the high-pressure branch HP or by the liquid separator 20''' of the third low-pressure branch LP3 through the second connection duct 21'''.

Operationally, also these second valve means 22'',23''' are actuated to allow the feeding of the evaporator 12'' of the second low-pressure branch LP2 with liquid coming from the liquid separator 20''' of the third evaporation branch LP3 when the evaporator 12''' of the third evaporation branch LP3 is made to operate in overfeeding conditions so as to discharge the liquid that is collected into the liquid separator 20'''. The aforesaid second valve means 22'', 23''' are therefore installed in such a position that their actuation does not interrupt the connection of said third low-pressure branch LP3 with the high-pressure branch.

Preferably, the aforesaid second valve means 22'',23''' comprise:—a first valve 22'' of connection between the high-pressure branch HP and the second low-pressure branch LP2; and—a second valve 23''' installed on such second connection duct 21'.

According to a particularly preferred embodiment, the aforesaid first valve 22'' is an on-off valve (in particular a solenoid valve), while the aforesaid second valve 23''' is a non-return valve.

The operation of the second valve means is identical to the operation of the first valve means described above, and will therefore not be repeated for brevity of explanation.

Operationally, if the two low-pressure branches LP1 and LP3 operate at different evaporation levels, they cannot feed the second low-pressure branch LP2 simultaneously, but alternately. Simultaneous feeding by both low-pressure branches is only possible if they are operating at the same evaporation level.

According to the diagram of FIG. 14A, the third evaporation level, at which the third low-pressure branch LP3 is operating, is higher than the first evaporation level at which the first low-pressure branch LP1 is operating.

More in detail, according to this diagram, the liquid separator 20''' of the third low-pressure branch LP3 is fluidically connected to the first low-pressure branch LP1 upstream of the expansion device 11' of this first low-pressure branch LP1 through a second connection duct 21'''. In its turn, the first low pressure branch LP1 is connected in the same way to the second low-pressure branch, i.e., in cascade.

The circuit 2 comprises third valve means 22', 23''' that are installed on the second connection duct 21''' and on the first low-pressure branch LP1 and are controllable (preferably by an electronic control unit, not illustrated in the attached figures) in such a way that the first low-pressure branch LP1 is fed alternately by the high-pressure branch HP or by the liquid separator 20''' of the third low-pressure branch LP3 through the second connection duct 21'''.

Operationally, these third valve means 22',23''' are actuated to allow the feeding of the evaporator 12' of the first low-pressure branch LP1 with liquid from the liquid separator 20''' of the third evaporation branch LP3 when the evaporator 12''' of the third evaporation branch LP3 is made to operate in overfeeding conditions so as to discharge the liquid that is collected into the liquid separator 20'''. The aforesaid third valve means 22',23''' are therefore installed in such a position that their actuation does not interrupt the connection of said third low-pressure branch LP3 with the high-pressure branch.

Preferably, the aforesaid third valve means 22',23''' are identical to the previously described first valve means and can be constituted in particular (as shown in FIG. 14A) by:—a first valve 22'' (preferably an on-off valve, in particular a solenoid valve) of connection between the high-pressure branch HP and the second low-pressure branch LP2; and—a second valve 23'''(preferably a non-return valve) installed on such second connection duct 21'.

According to an alternate embodiment shown for example in FIG. 14B, the aforesaid third valve means can be constituted by a three-way valve 24''', which connects the first low-pressure branch LP1 alternately to the high-pressure branch HP and to the second connection duct 21'''.

Preferably, as illustrated in the attached FIGS. 3A to 9 and 11 to 14B, the high pressure branch HP can comprise a liquid receiver 16 placed downstream of the heat exchanger 10 (condenser or gas cooler).

Advantageously, as illustrated in FIGS. 6, 7, 9, 11 and 12, each liquid separator 20',20''' can be fluidically connected to said liquid receiver by means of a pump 30 or another circulator to discharge the liquid collected into the liquid separator 20',20''' to the receiver 16 in the case of exceeding a safety level inside the liquid separator 20', 20'''.

Preferably, each liquid separator is equipped with means for detecting the liquid level usable to control the actuation of the aforesaid valve means and the intervention of the safety pump 30 and/or for the interruption of the overfeeding and the restoration of a degree of superheating.

According to a preferred embodiment, the aforesaid level detecting means are punctual meters, placed at three different levels of the liquid separator:

- a minimum level, below which the valve means are actuated to prevent the feeding of the liquid by the separator to the advantage of the high-pressure branch HP;
- an intermediate level, above which the valve means are actuated to allow the feeding of the liquid by the separator alternately to the high-pressure branch HP; and
- a maximum level, above which said pump 30 is activated to recirculate at least part of the liquid to said receiver 16, or, alternately or in parallel, above which the functioning in overfeeding of the evaporator that discharges in the separator is stopped restoring a degree of superheating at the evaporator outlet.

Preferably, the three levels at which the meters are placed are respectively:

- minimum level: in a position not less than 0% and not more than 10% of the capacity of the separator 20',20";
- intermediate level: in a position not less than 30% and not more than 40% of the capacity of the separator 20',20";
- maximum level: in a position not less than 50% and not more than 60% of the capacity of the separator 20',20".

As mentioned earlier, the vapour compression cycle can be trans-critical and, in particular, use CO2 as refrigerant.

Preferably, as illustrated in FIGS. 3A to 9 and FIGS. 13, 14A, and 14B, in the case in which the vapour compression cycle is trans-critical, the high-pressure branch HP can also comprise an expansion device 15 arranged between the heat exchanger 10 (gas cooler) and the liquid receiver 16.

The liquid receiver 16 can be connected through a flash gas valve 17 alternately or exclusively:

- to the intake of the compressor group 13',14''' of the low-pressure branch LP1, LP3 operating at the highest evaporation level (as illustrated in FIGS. 3A, 3B, 8, 9, 13, 14A, and 14B); or
- to the liquid separator 20',20''' of the low-pressure branch LP1, LP3 operating at the highest evaporation level (as illustrated in FIGS. 4, 5, 6 and 7).

Advantageously, in the second case, by discharging the flash gas to the liquid separator 20',20" of the low-pressure branch LP1, LP3 operating at the highest evaporation level, it is possible to recover the liquid produced by its expansion, making it available for feeding the evaporators of the low-pressure branches operating at lower evaporating levels.

Figure 7:
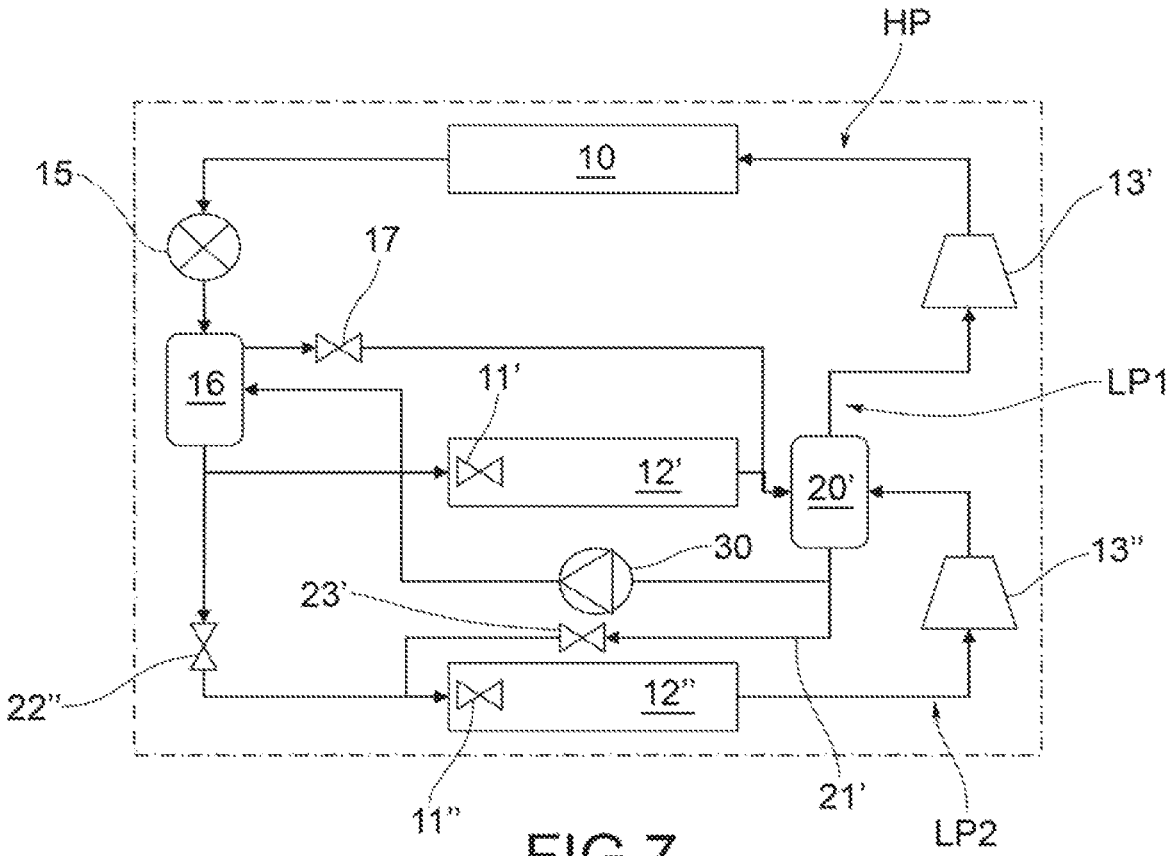
FIG. 7 shows a variant of the plant diagram of FIG. 6 that provides for the discharge of the compressor of the lower evaporation level into the phase separator placed downstream of the higher evaporation level.
Figure 8:
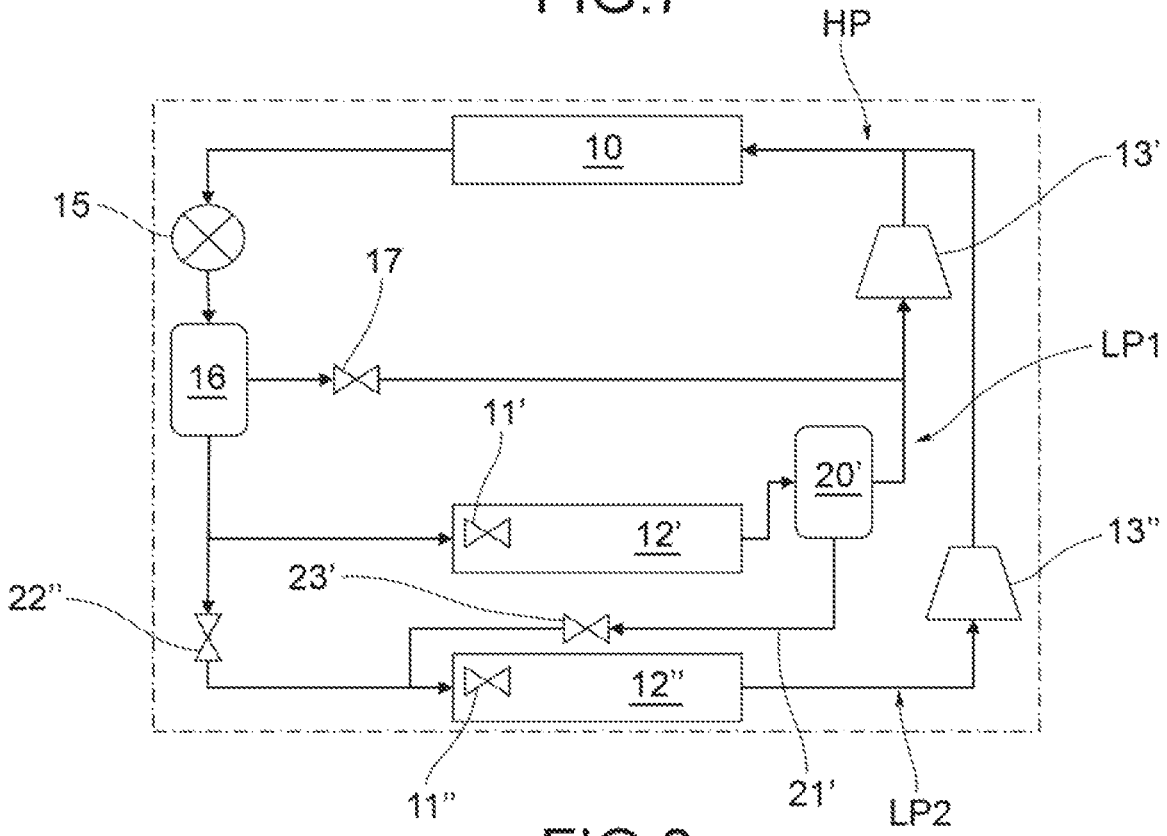
FIG. 8 shows a simplified diagram of a trans-critical refrigeration plant with two evaporation levels arranged in parallel, according to a different embodiment of this invention.
Figure 9:
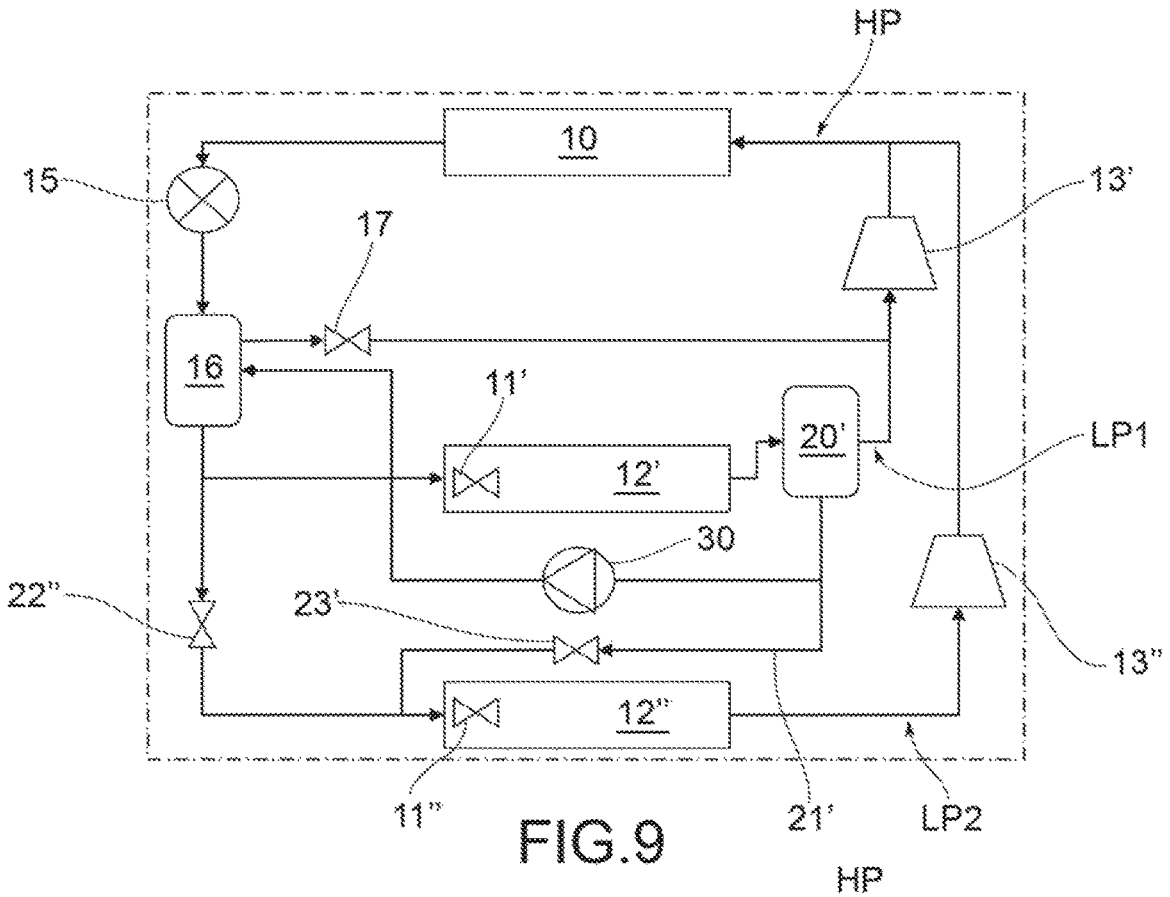
FIG. 9 shows a variant of the plant diagram of FIG. 8 that in addition provides for a circulation pump for the discharge of the excess liquid collected into the phase separator placed downstream of the higher evaporation level towards the liquid receiver upstream of the evaporation levels.
Figure 10:
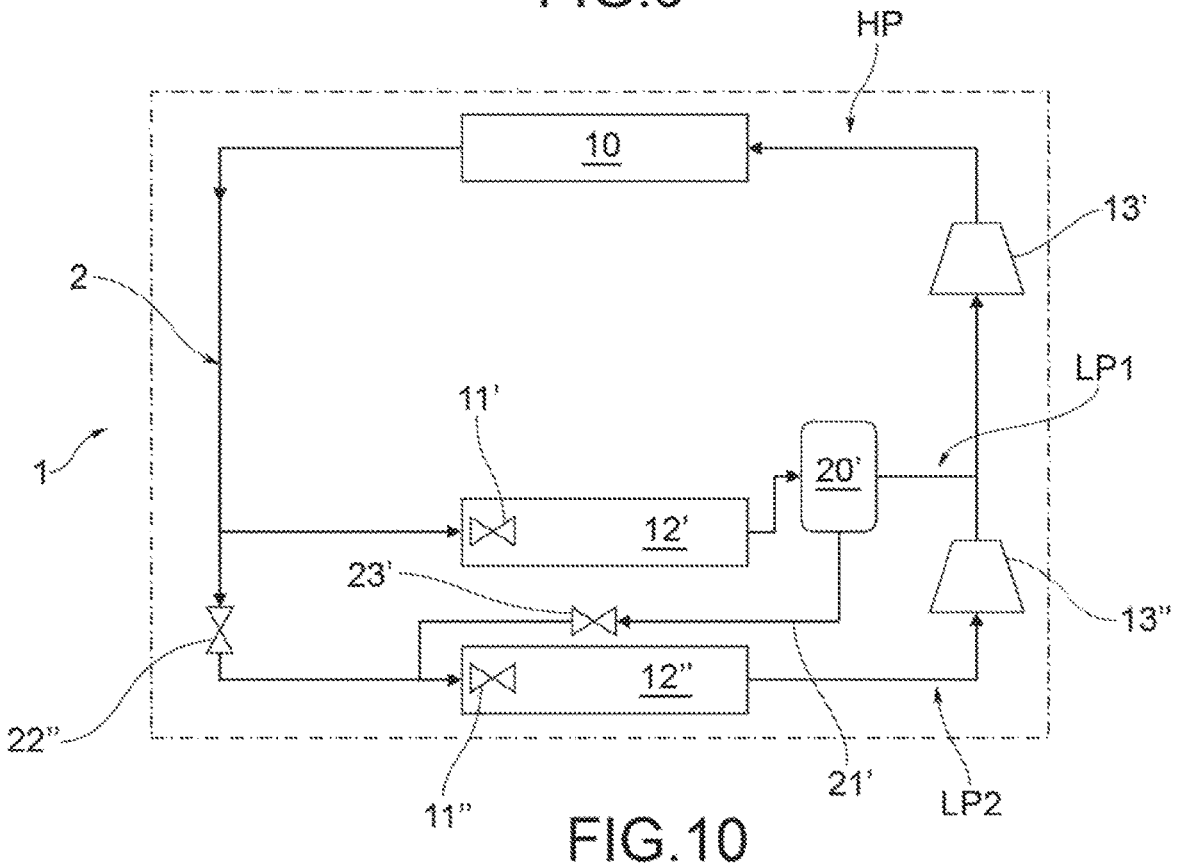
FIG. 10 shows a simplified diagram of a trans-critical refrigeration plant with two evaporation levels arranged in series, according to a further embodiment of this invention.
Figure 11:
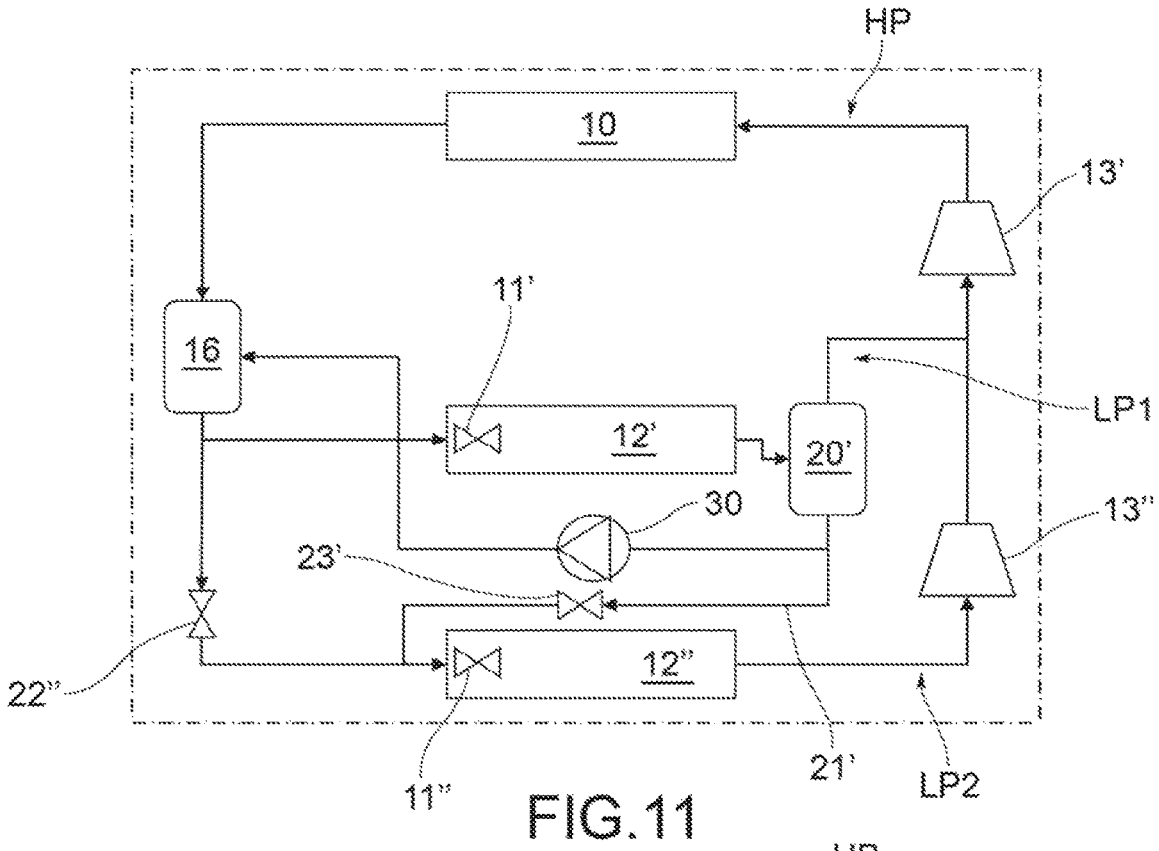
FIG. 11 shows a variant of the plant diagram of FIG. 10 that in addition provides for a circulation pump for the discharge of the excess liquid collected into the phase separator placed downstream of the higher evaporation level towards a liquid receiver upstream of the evaporation levels.

The compressor groups 13',13"; 13''' of the various low-pressure branches LP1, LP2, LP3 are connected to the high-pressure branch HP:

- all in series with each other according to their respective evaporation levels (as illustrated in FIGS. 3A, 3B, 4, 5, 6, 7, 10, 11 and 12); or
- all in parallel (as illustrated in FIGS. 8 and 9); or
- according to a mixed series and parallel scheme (as illustrated in FIGS. 13, 14A, and 14B).

Figure 5:
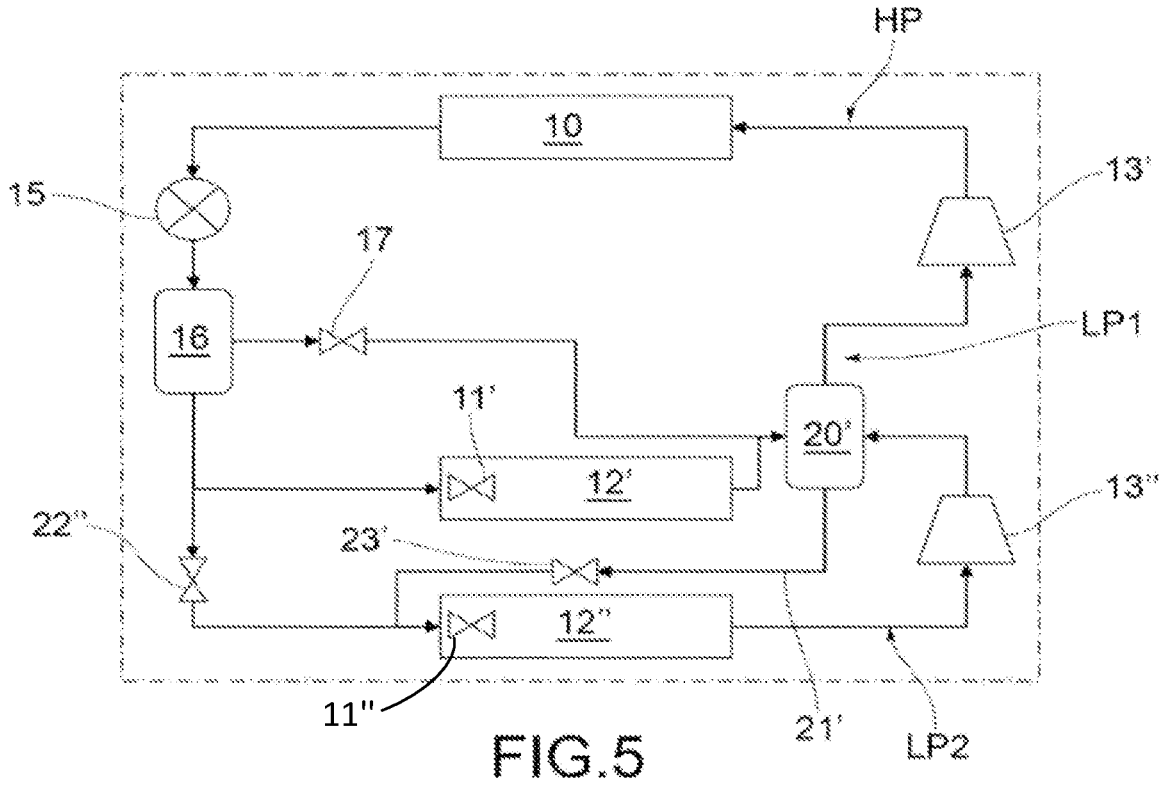
FIG. 5 shows a variant of the plant diagram of FIG. 4 that provides for the discharge of the compressor of the lower evaporation level in the phase separator placed downstream of the higher evaporation level.
Figure 6:
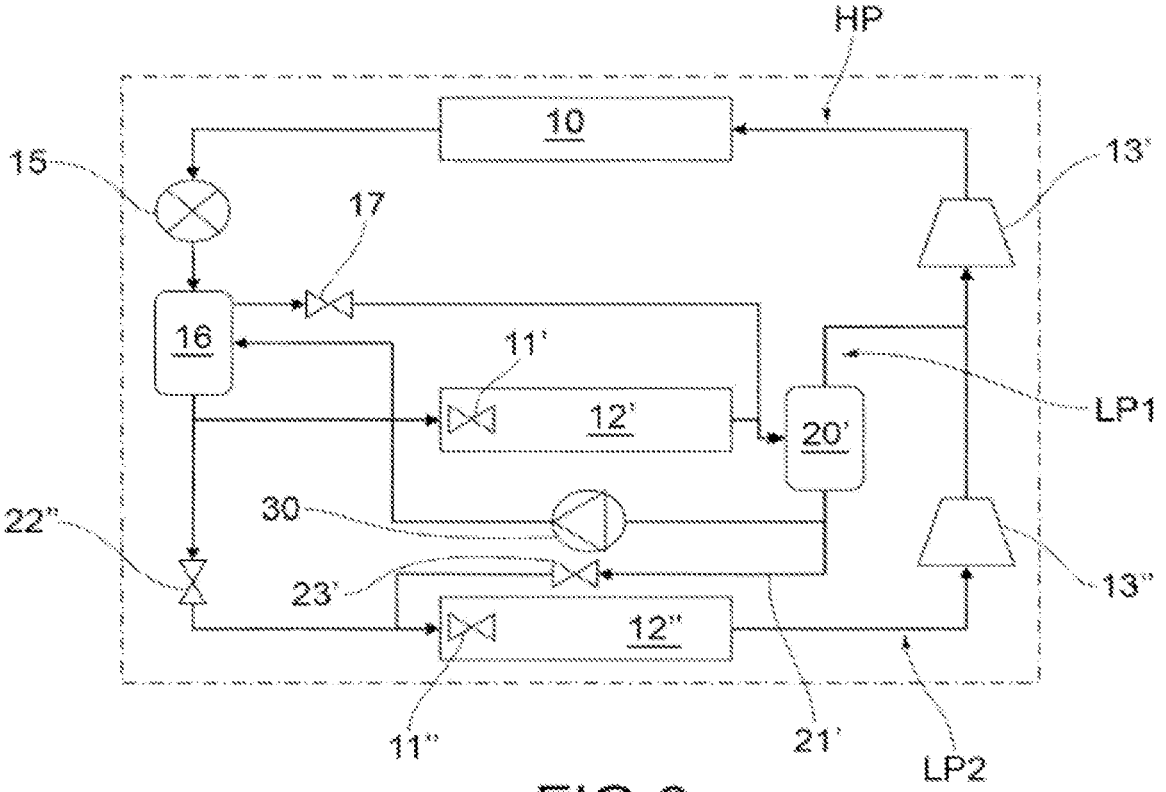
FIG. 6 shows a variant of the plant diagram of FIG. 4 that in addition provides for a circulation pump for the discharge of the excess liquid collected into the phase separator placed downstream of the higher evaporation level towards the liquid receiver upstream of the evaporation levels.
Figure 12:
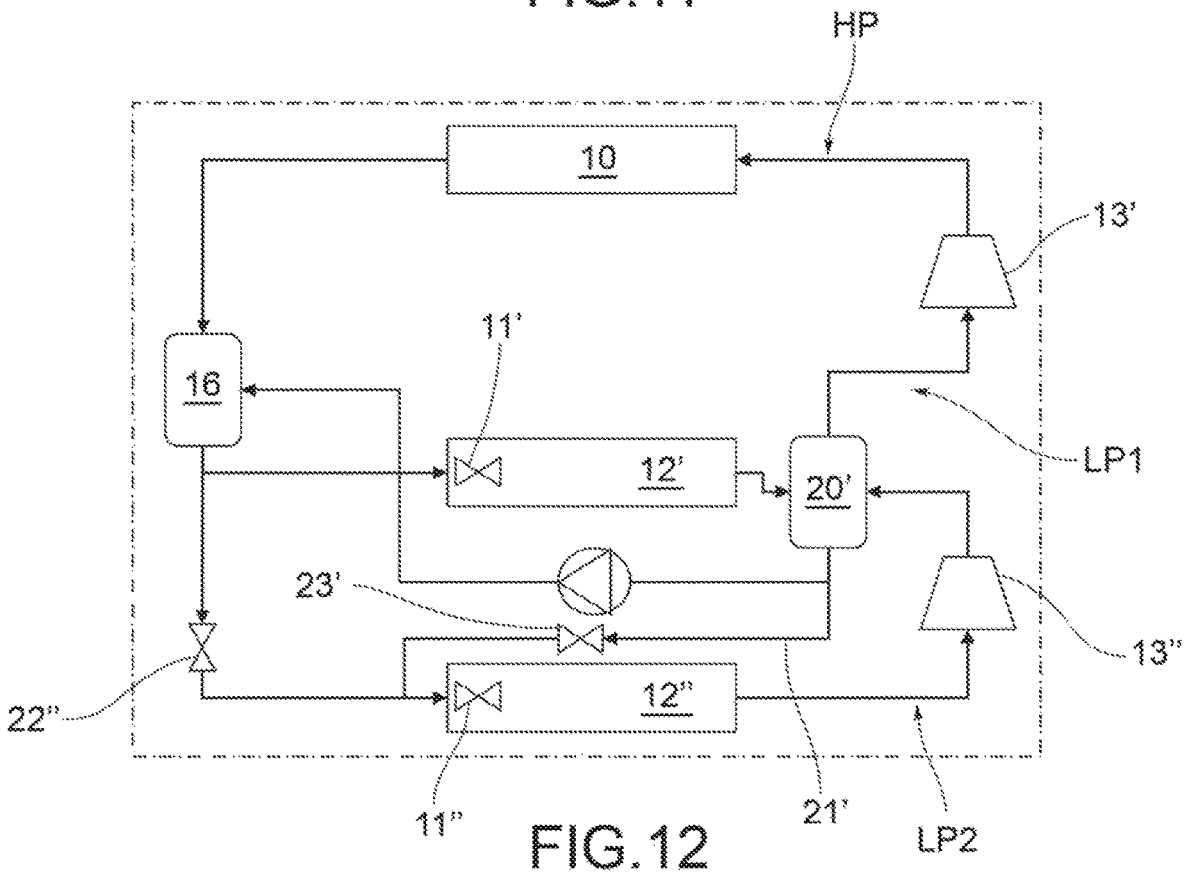
FIG. 12 shows a variant of the plant diagram of FIG. 11 that provides for the discharge of the compressor of the lower evaporation level into the phase separator placed downstream of the higher evaporation level.

The discharge of the compressor group 13" of a low-pressure branch LP2 can be connected, alternatively or exclusively:

- to the intake of the compressor group 13' of a low-pressure branch LP1 operating at a higher evaporation level (as illustrated in FIGS. 3A, 3B, 4, 6, 10, 11, 13, 14A, and 14B); or
- to the liquid separator 20' of a low-pressure branch LP1 operating at a higher evaporation level (as illustrated in FIGS. 5, 7 and 12).

Advantageously, the discharge of the compressor group 13" of a low-pressure branch of LP2 to the liquid separator 20' of a low-pressure branch LP1 operating at a higher evaporation level leads to a greater stability of intake temperature of the compressor group 13", mitigating the effects of oscillation due to turning the compressor group of this low-pressure branch on and off, with the consequent possibility of simplifying and removing some control functions of the intake temperature, such as the expansion of liquid in intake to the compressors of such low-pressure branch.

Preferably, as illustrated in the plant diagrams of attached figures, the low pressure branch LP2 that operates at the lowest evaporation level is not equipped with a separator of the liquid exiting to its own evaporator 13". For this low-pressure branch, preferably, it is provided for maintaining a degree of superheating at the outlet of the evaporator 13".

According to an embodiment not illustrated in the attached figures, also the low-pressure branch LP2 that operates at the lowest evaporation level can be equipped with an own separator of the liquid exiting to the evaporator 13", so that similarly to the other low-pressure branches it is possible to operate in overfeeding. In this case, since it is not possible to discharge the overfeeding of liquid towards another low pressure branch operating at a lower evaporation level, the separator can be fluidically connected to the liquid receiver placed in the high-pressure branch through a pump or other circulator device providing a continuous or intermittent recirculation of the overfeeding liquid in the high-pressure branch.

Advantageously, the refrigeration plant 1 comprises an electronic control unit to allow automatic management.

Now, it will described the method of managing a refrigeration plant with multiple evaporation levels according to this invention. In particular, this method can be implemented in a refrigeration plant according to the invention, in particular as described above. For simplicity of explanation, when referring to components of such a refrigerator plant, the same reference numbers will be used.

The method according to the invention is a method for managing a refrigeration plant that operates according to a vapour compression cycle and comprises:

- a circuit 2 having a high-pressure branch HP, in which is arranged at least one heat exchanger 10, which functions as a condenser or gas cooler; and two or more low-pressure branches LP1, LP2, LP3, each of which operates at a different evaporation level to serve users having different refrigeration requirements.

In each low-pressure branch LP1, LP2, LP3 the aforesaid plant comprises:—an expansion device 11',11",11'"; —at least one evaporator 12',12",12'"; and a compressor group 13',13",13'".

According to a form of general implementation of the invention, said method comprises the following operational steps:

a) regulating the degree of superheating of the evaporator 12',12",12'" of each low-pressure branch as a function of the instant thermal load imposed by the user according to a logic of reduction of the power absorbed by the relative compressor group 13',13", 13'";

b) eliminating the degree of superheating of the at least one evaporator 12' of at least a first low-pressure branch LP1 operating at a first evaporation level causing it to operate in overfeeding conditions in order to improve the exploitation of the heat exchange surface in said evaporator 12' according to a logic of reduction of the power absorbed by the related compressor group 13', 13",13'";

c) collecting the liquid exiting such evaporator 12' in a liquid separator 20', feeding the compressor group 13' of such first low-pressure branch only with the gas phase present in such separator 20'.

Advantageously, the degree of superheating of an evaporator is regulated according to procedures that are in themselves known to a person skilled in the sector and that will therefore not described here. It is only mentioned that the degree of superheating is regulated, in particular, by acting on the opening of the expansion device upstream of the evaporator, controlling the opening according to a feedback control based on the measurement of the degree of superheating at the evaporator outlet (for example by means of a pressure probe and a temperature probe).

Advantageously, how to make an evaporator operate in overfeeding conditions is also in itself known by a person skilled in the art and therefore will not be described here.

According to the invention, the managing method comprises an operating step d) of discharging the (overfeeding) liquid that collects in the liquid separator 20' by exclusively feeding with such liquid a second low-pressure branch LP2 operating at an evaporation level lower than the first, and temporarily interrupting the feeding of said second low-pressure branch LP2 by the high-pressure branch HP.

Preferably, if said second low-pressure branch LP2 operates at the lowest evaporation level of the plant, during said step c) of discharging the liquid, the evaporator 12" of said second low-pressure branch LP2 is made to operate maintaining a degree of superheating exiting the respective evaporator 12" to avoid that liquid is taken in by the compressor group 13" of said second low-pressure branch LP2.

Alternatively, as already described in relation to the plant according to the invention, the second low-pressure branch LP2 operating at the lowest evaporation level of the plant can also be made to operate in conditions of overfeeding. In this case, the overfeeding liquid collected into a liquid separator will be recirculated to a receiver in the high-pressure branch.

According to a possible form of implementation of the method according to the invention, if the aforesaid second low-pressure branch LP2 operates at an intermediate evaporation level between the different evaporation levels of the plant, during the aforesaid liquid discharge step d) two options, in particular, are available;

the evaporator 12" of said second low-pressure branch LP2 can be made to operate maintaining a degree of superheating exiting the respective evaporator 12" to avoid that liquid is taken in by the compressor group 13" of said second low-pressure branch LP2; or the steps b), c) and d) are repeated also on said second low-pressure branch LP2, operating in cascade on another low-pressure branch operating at a lower evaporation level.

According to a further possible form of implementation of the method according to the invention, at least two different low-pressure branches LP1, LP3 can both be made to operate in overfeeding conditions by performing for both the aforesaid step b) of eliminating the degree of superheating. During the aforesaid discharge step d), the liquid which exits from the evaporators 12',12'" of said at least two different low-pressure branches LP1, LP3 and which is collected into respective liquid separators 20',20'", is discharged by temporarily feeding in an exclusive manner with this liquid a same low-pressure branch LP2 operating at a lower evaporation level.

As already said previously in relation to the plant according to the invention, if the two low-pressure branches LP1 and LP3 are operating at different evaporation levels, they cannot feed the second low-pressure branch LP2 simultaneously, but alternately. Simultaneous feeding by both low-pressure branches is only possible if they are operating at the same evaporation level.

Preferably, the managing method comprises a step e) of detecting the level of liquid collected into the phase separator 20',20'".

Advantageously, the aforesaid step d) of discharging the liquid collected into the phase separator 20', 20'" is interrupted if, during level detection step e) a liquid level is detected lower than a predetermined minimum level. As already mentioned, when describing the operation of the plant according to the invention, the interruption of step d) implies that the low-pressure branch into which the overfeeding liquid was being discharged is again fed from the high-pressure branch.

Advantageously, the method can comprise a step f) of recirculating, through a pump 30 or other circulator device, the liquid collected into the phase separator 20',20'" to a liquid receiver 16 placed in the high-pressure branch HP. This step f) is carried out if, during level control step e) a liquid level is detected higher than a predetermined maximum level. Such step f) is therefore carried out only as a safety intervention, aimed at safeguarding the compressor group from the risk of taking in liquid.

Advantageously, step b) of eliminating the degree of superheating of the evaporator operating in overfeeding is interrupted and a degree of superheating is restored if, during step e) of detecting the level, a liquid level is detected higher than a predetermined maximum level.

Interruption of step b) can be operated in parallel or alternatively to recirculation step f) of the liquid to the high-pressure branch through a pump 30.

The method of managing a refrigeration plant can comprise a step g) of defrosting one or more of the evaporators 12',12",12'". This defrosting step g) can be advanced or delayed as a function of the level of liquid collected into the respective liquid separator 20',20'". In particular, step g) is advanced if the level of liquid collected is near to the predetermined minimum level, while it is postponed if the level of liquid collected is near to the predetermined maximum level.

Advantageously, the method of managing a refrigeration plant according to the invention is managed automatically by an electronic control unit.

In fact, based on the temperature of the refrigeration air, two main types of users can be distinguished:

- positive temperature users, i.e., with evaporation temperature between −10° C. and 0° C. and air temperature >0° C.; and
- negative temperature users, i.e., with evaporation temperature between −40° C. and −20° C. and air temperature <0° C.

Preferably, but not necessarily the evaporators that are made to operate in overfeeding are the evaporators that serve users operating at positive temperatures, while the evaporators that discharge the overfeeding liquid are the evaporators that serve users operating at negative temperatures.

Advantageously, the regulation of the degree of superheating at the evaporator of one or more low-pressure branches and the choice of making it operate in conditions of overfeeding can follow different logics.

Below, some of such possible logics are listed by way of non-limiting example:

- the superheating can be modified up to its elimination (operating in overfeeding conditions) only at some or at all of the evaporators identified as most critical based on the design parameters and depending on the refrigeration needs of the users served;
- the superheating can be modified up to its elimination (operating in overfeeding) only at some or at all of the evaporators that inhibit the raising of the evaporation pressure set-point of the compressors: these evaporators can be identified through the optimisation programs of the floating evaporation pressure in widespread use in the main of refrigeration control systems;
- the superheating set point can be continuously modified only for some or for all of the evaporators as a function of the variation of the liquid level in the separator or by threshold upon reaching several discrete liquid level values;
- the superheating set-point can only be modified continuously only at some or at all the evaporators as a function of the variation of the call status of the evaporators of the branches that are operating at the lowest evaporation levels (in particular those that operate at negative temperatures) and of the temporal distance with respect to the next defrost.
- the defrosting of the evaporators that operate at the lowest evaporation levels (in particular those that operate at negative temperatures) can be anticipated or postponed as a function of the liquid level in the separator.

The invention allows obtaining many advantages that have been explained during the course of the description.

The refrigeration plant according to the invention is configured so as to allow the exploitation of the technique of overfeeding one or more evaporators without adversely affecting the compressors, and at the same time is constructively simpler than the known systems.

In particular, thanks to the invention, there is no need for devices to recirculate the liquid in the high-pressure branch, such as ejectors or pumps. The use of recirculation devices in the high-pressure branch can be provided, but only and possibly as a safety device in the event of an excessive accumulation of liquid in the separator.

In this case, the presence of circulators is ancillary and not essential for the plant working. The requested circulator has dimensions and consumptions lower than those of the circulators requested in a traditional pumped plant, since the circulator is sized for moving only a quantity of fluid much lower than the total flow rate requested by the refrigerating users and since the path to do has a limited extension and is not influenced by the arrangement and the position of the refrigerating users. The failure of said recirculating device does not cause malfunctions of the plant, nor service interruption of the refrigerating users since it is not essential for the circulation of the refrigerant fluid.

Even with plant solutions that are, on the whole, simple, it is thus possible to obtain all the advantages of the overfeeding technique:

- elimination of the inefficiency of superheating at the evaporator outlet;
- greater use of the evaporator surface and consequent possibility of increasing the evaporation temperature and thus decreasing the energy consumption of the compressors;
- decreasing the intake temperature of the compressors and thus at the discharge with related mitigation of problems linked to high discharge temperatures such as deterioration of the lubricant oil and of some parts of the compressor.

The presence of a liquid/vapour phase separator downstream of the evaporator increases the reliability of the system since it prevents the return of liquid to the compressors even in the event of failure of one of the expansion devices (understood as a combination of valves and pressure, temperature and control sensors) in the evaporators or in case of excessive return of liquid formed by the expansion of the flash gas. This elimination of the risk of liquid returning can lead to the simplification of the superheating control devices such as the injection of hot gas in the intake to the compressors and make superfluous the presence of systems such as anti-liquid bottles.

Thanks to the invention, unlike the prior art solutions, all of these advantages are, however, achievable with a simple plant layout that does not require the recirculation of excess liquid to the high-pressure branch.

The alternative solution of discharging the overfeeding liquid provided by the invention is also in itself an improvement of the efficiency of the plant. In fact, the discharge of the liquid generated by overfeeding to an evaporator operating at a lower level of refrigeration makes it possible to exploit a refrigerant liquid with a lower level of enthalpy. This implies a greater enthalpy jump available to the users served by the low-pressure branch fed with such overfeeding liquid. The increase in the enthalpy jump available to such users reduces the refrigerant flow required by these same users. Consequently, at least limited to the low pressure branch affected by the feeding of this overfeeding liquid, there is a reduction of load losses, as well as a lower consumption of energy by the compressor group.

The refrigeration plant according to the invention thus does not require complex plant solutions. The plant costs are therefore comparable if not lower than those of conventional plants.

The refrigeration plant according to the invention results also to be reliable and operationally simple to manage. In fact, the control logics required are no more complex than those already in use in conventional plants.

The method of managing a refrigeration plant with multiple evaporation levels according to the invention provides the possibility of exploiting the technique of overfeeding one or more evaporators in order to improve the efficiency of heat exchange without negative effects on the compressor and is operationally simple to implement.

The refrigeration plant according to the invention is configured in such a way to allow feeding of the evaporator (or evaporators) of the low-pressure branch working at the lowest evaporation level (in particular, the second low-pressure branch LP2) without interrupting or changing the feeding to the evaporators of the low-pressure branches working at higher evaporation levels (in particular, the first low-pressure branch LP1 and the second low-pressure branch LP3). The arrangement of the valve means able to commuting the feeding of the evaporator (or evaporators) of such second low-pressure branch LP2 allows a continuity of feeding to the evaporators of the low-pressure branches working at evaporation levels higher in all the conditions of feeding of the evaporator (or evaporators) of said second low-pressure branch. In particular, such feeding continuity is allowed both in the case in which the evaporator (or evaporators) of said second low-pressure branch LP2 is fed directly by the high-pressure branch, and in the case in which the evaporator (or evaporators) of said second low-pressure branch LP2 is fed directly by the liquid separator placed downstream from the evaporator (or evaporators) of the low-pressure branches working at higher evaporation levels.

Advantageously, the independent functioning of the evaporators of the low-pressure branches working at higher evaporation levels allows to control the conditions of suction at the compressors in order to avoid malfunction conditions which can jeopardize the reliability and the efficiency in the functioning of said compressors, without influencing negatively on the functioning of the evaporator (or evaporators) of such second low-pressure branch LP2.

Therefore, the invention thus conceived achieves the predefined purposes.

Obviously, it may even assume, in its practical embodiment, forms and configurations different from that illustrated above without, for this reason, departing from the present scope of protection.

Moreover, all the details may be replaced by technically equivalent elements and the dimensions, forms and materials used may be any according to the needs.

The invention claimed is:

1. A refrigeration plant with multiple evaporation levels, operating according to a vapour compression cycle, the refrigeration plant comprising:

a circuit comprising:

a high-pressure branch, wherein is arranged at least one heat exchanger, which functions as a condenser or gas cooler, and two or more low-pressure branches, each of which operates at a different evaporation level to serve users having different refrigeration requirements, each low-pressure branch of the two or more low-pressure branches of said refrigeration plant comprising an expansion device, at least one evaporator, and a compressor group, each of the two or more low-pressure branches having at least one evaporator connected directly to said high-pressure branch, wherein a first low-pressure branch of the two or more low-pressure branches operating at a first evaporation level comprising a liquid separator that is fluidically connected:

to an evaporator outlet of said first low-pressure branch to collect a liquid exiting the at least one evaporator of the first low-pressure branch when the at least one evaporator of the first low-pressure branch is operating in overfeeding conditions; and to an intake of the compressor group of said first low-pressure branch;

wherein said liquid separator of the first low-pressure branch is not fluidically connected to an inlet of the at least one evaporator of said first low-pressure branch, but is fluidically connected to a second low-pressure branch of the two or more low-pressure branches operating at a second evaporation level lower than the first evaporation level upstream of the expansion device of the second low-pressure branch through a first connection duct, and wherein said circuit comprises first valve means comprising one or more valves that are installed in the first connection duct and in the second low-pressure branch and are controllable in such a way that said second low-pressure branch is alternately fed by the high-pressure branch or by said liquid separator of the first low-pressure branch through said first connection duct, said first valve means being actuated to allow feeding the at least one evaporator of the second low-pressure branch with liquid coming from the liquid separator of the first low-pressure branch when the at least one evaporator of the first low-pressure branch is made to operate in overfeeding conditions so as to discharge the liquid that collects in said liquid separator of the first low-pressure branch.

2. The refrigeration plant according to claim 1, wherein the one or more valves of said first valve means comprise:

a first valve of connection between the high-pressure branch and the second low-pressure branch and a second valve installed on said first connection duct, or a three-way valve, which connects the second low-pressure branch alternately to the high-pressure branch and to the first connection duct.

3. The refrigeration plant according to claim 1, wherein said circuit comprises a third low-pressure branch that operates at a third evaporation level higher than the second evaporation level and that comprises a liquid separator of the third low-pressure branch fluidically connected:

to an evaporator outlet of said third low-pressure branch to collect the liquid exiting the at least one evaporator when the at least one evaporator of said third low-pressure branch is operating in overfeeding conditions; and to an intake of the compressor group of said third low-pressure branch.

4. The refrigeration plant according to claim 3, wherein the liquid separator of said third low-pressure branch is also fluidically connected to said second low-pressure branch operating at said second evaporation level lower than the first and third evaporation level upstream of the expansion device of the second low-pressure branch through a second connection duct, and wherein said circuit comprises second valve means comprising one or more valves that are installed on the second connection duct and on the second low-pressure branch and are controllable in such a way that said second low-pressure branch is alternately fed by the high-pressure branch or by the liquid separator of said third low-pressure branch through said second connection duct, said second valve means being actuated to allow feeding the at least one evaporator of the second low-pressure branch with liquid coming from the liquid separator of the third low-pressure branch when the at least one evaporator of the third low-pressure branch is made to operate in overfeeding conditions so as to discharge the liquid that collects in said liquid separator of the third low-pressure branch.

5. The refrigeration plant according to claim 4, wherein the one or more valves of said second valve means comprise:

a first valve of connection between the high-pressure branch and the second low-pressure branch, and a second valve installed on said second connection duct.

6. The refrigeration plant according to claim 3, wherein the third evaporation level at which the third low-pressure branch operates is higher than the first evaporation level at which the first low-pressure branch operates and wherein the liquid separator of the third low-pressure branch is also fluidically connected to said first low-pressure branch upstream of the expansion device of the first low-pressure branch through a second connection duct, said circuit comprising third valve means comprising one or more valves that are installed on the second connection duct and on the first low-pressure branch and are controllable in such a way that said first low-pressure branch is alternately fed by the high-pressure branch or by the liquid separator of said third low-pressure branch through said second connection duct, said third valve means being actuated to allow feeding the at least one evaporator of the first low-pressure branch with liquid coming from the liquid separator of the third low-pressure branch when the at least one evaporator of the third low-pressure branch is made to operate in overfeeding conditions so as to discharge the liquid that collects in said liquid separator.

7. The refrigeration plant according to claim 6, wherein the one or more valves of said third valve means comprise:

a first valve of connection between the high-pressure branch and the first low-pressure branch and a second valve installed on said second connection duct, or a three-way valve, which connects the first low-pressure branch alternately to the high-pressure branch and to the second connection duct.

8. The refrigeration plant according to claim 1, wherein the high-pressure branch comprises a liquid receiver arranged downstream of the at least one heat exchanger.

9. The refrigeration plant according to claim 8, wherein at least one of:

the liquid separator of the first low-pressure branch is fluidically connected to said liquid receiver via a pump to discharge the liquid collected into the liquid separator of the first low-pressure branch to the liquid receiver in response to the liquid exceeding a safety level inside the liquid separator of the first low-pressure branch, and the liquid separator of a third low-pressure branch is fluidically connected to said liquid receiver via a pump to discharge the liquid collected into the liquid separator of the third low-pressure branch to the liquid receiver in response to the liquid exceeding a safety level inside the liquid separator of the third low-pressure branch.

10. The refrigeration plant according to claim 1, wherein at least one of the liquid separator of the first low-pressure branch and a liquid separator of a third low-pressure branch is provided with a liquid level detection means comprising a meter.

11. The refrigeration plant according to claim 9, wherein liquid level detection means comprising a meter are placed at three different levels of at least one of: the liquid separator of the first low-pressure branch and the liquid separator of the third low-pressure branch, wherein:

for the liquid separator of the first low-pressure branch, the three levels are:

a minimum level, below which the first valve means are actuated to prevent the feeding of the liquid by the liquid separator of the first low-pressure branch to the high-pressure branch;

an intermediate level, above which the first valve means are actuated to allow the feeding of the liquid by the liquid separator of the first low-pressure branch alternately to the high-pressure branch; and a maximum level, above which said pump is activated to recirculate at least part of the liquid to said liquid receiver, or, alternately or jointly, for the at least one evaporator that discharges in the liquid separator of the first low-pressure branch, overfeeding is stopped restoring a degree of superheating; and for the liquid separator of the third low-pressure branch:

a minimum level, below which a third valve means are actuated to prevent the feeding of the liquid by the liquid separator of the first low-pressure branch to the high-pressure branch;

an intermediate level, above which the third valve means are actuated to allow the feeding of the liquid by the liquid separator of the third low-pressure branch alternately to the high-pressure branch; and a maximum level, above which said pump is activated to recirculate at least part of the liquid to said liquid receiver, or, alternately or jointly, for the at least one evaporator that discharges in the liquid separator of the third low-pressure branch, overfeeding is stooped restoring a degree of superheating.

12. The refrigeration plant according to claim 8, wherein the vapour compression cycle uses $CO_2$ as refrigerant, the high-pressure branch comprising an expansion device of the high-pressure branch arranged between the at least one heat exchanger, which functions as the condenser or gas cooler, and the liquid receiver.

13. The refrigeration plant according to claim 12, wherein the liquid receiver is connected through a flash gas valve alternately or exclusively:

to the intake of the compressor group of the low-pressure branch operating at the highest evaporation level; or to the liquid separator of the first low-pressure branch operating at the highest evaporation level.

14. The refrigeration plant according to claim 1, wherein ah compressor group of the two or more low-pressure branches is connected to the high-pressure branch, wherein the two or more compressor groups are connected:

all in series with each other according to respective evaporation levels of the two or more low-pressure branches; or all in parallel; or according to a mixed series and parallel scheme.

15. The refrigeration plant according to claim 1, wherein the discharge of the compressor group of the second low-pressure branch is connected, alternatively or exclusively, to the intake of the compressor group or to the liquid separator of the first low-pressure branch operating at a higher evaporation level.

16. The refrigeration plant according to claim 1, wherein in each low-pressure branch of the two or more low-pressure branches of said refrigeration plant is equipped with devices suitable to change the operating conditions of the relative at least one evaporator of the two or more low-pressure branches to make the evaporator operate in superheating conditions at the outlet by adjusting a degree of superheating and to make the evaporator operate in overfeeding conditions.

17. A method of managing a refrigeration plant with multiple evaporation levels, operating according to a vapour compression cycle, the refrigeration plant comprising:

a circuit comprising:

a high-pressure branch, wherein is arranged at least one heat exchanger, which functions as a condenser or gas cooler, and two or more low-pressure branches, each of which operates at a different evaporation level to serve users having different refrigeration requirements, in each low-pressure branch of the two or more low-pressure branches of said refrigeration plant comprising an expansion device, at least one evaporator and a compressor group, each of the two or more low-pressure branches having at least one evaporator connected directly to said high-pressure branch, said method comprising the following operating steps:

a) regulating a degree of superheating of the at least one evaporator of each of the two or more low-pressure branches as a function of an instant thermal load imposed by a user to reduce power absorbed by the relative compressor group of the two or more low-pressure branches;

b) eliminating the degree of superheating of the at least one evaporator of a first low-pressure branch of the two or more low-pressure branches operating at a first evaporation level causing the first low-pressure branch to operate in overfeeding conditions in order to improve exploitation of p heat exchange efficiency of the heat exchange surface in said at least one evaporator to reduce the power absorbed by the relative compressor group of the two or more low-pressure branches;

c) collecting a liquid exiting the at least one evaporator of the first low-pressure branch in a liquid separator, feeding the compressor group of the first low-pressure branch only with a gas phase present in the liquid separator, and d) discharging the liquid that collects in said liquid separator exclusively feeding with the collected liquid a second low-pressure branch of the two or more low-pressure branches operating at a second evaporation level lower than the first evaporation level, temporarily interrupting the feeding of said second low-pressure branch by feeding the high-pressure branch.

18. The method of managing the refrigeration plant with multiple evaporation levels according to claim 17, wherein:

if said second low-pressure branch operates at the lowest evaporation level of the refrigeration plant, during said discharging the liquid, the evaporator of said second low-pressure branch is made to operate maintaining a degree of superheating exiting the respective evaporator to avoid that liquid is taken in by the compressor group of said second low-pressure branch, while if said second low-pressure branch operates at an intermediate evaporation level between the different evaporation levels of the two or more low-pressure branches of the refrigeration plant, during said discharging the liquid:

the evaporator of said second low-pressure branch is configured to operate maintaining a degree of superheating exiting the respective evaporator of the two or more low-pressure branches to avoid that liquid is taken in by the compressor group of said second low-pressure branch;

or the steps b), c) and d) are repeated also on said second low-pressure branch, operating on another low-pressure branch operating at a lower evaporation level.

19. The method of managing the refrigeration plant according to claim 17, wherein at least two different low-pressure branches are both made to operate in overfeeding conditions performing step b) for both and wherein in said step d) the liquid, which exits from the evaporators of said at least two different low-pressure branches and which is collected into the liquid separator, is discharged temporarily feeding in an exclusive manner with this liquid a same low-pressure branch operating at a lower evaporation level.

20. The method of managing the refrigeration plant according to claim 17, comprising a step e) of detecting a level of liquid collected into the liquid separator.

21. The method of managing the refrigeration plant according to claim 20, wherein said step d) of discharging the liquid collected into the liquid separator is interrupted if, during level detection step e) a liquid level is detected lower than a predetermined minimum level.

22. The method of managing the refrigeration plant according to claim 20, comprising a step f) of recirculating by means of a pump the liquid collected into the liquid separator to a liquid receiver arranged in the high-pressure branch, said step f) being performed if, during step e) of detecting the level, a liquid level is detected higher than a predetermined maximum level.

23. The method of managing the refrigeration plant according to claim 20, wherein said step b) of eliminating the degree of superheating of the evaporator operating in overfeeding is interrupted and a degree of superheating is restored if, during step e) of detecting the level, a liquid level is detected higher than a predetermined maximum level.

24. The method of managing the refrigeration plant according to claim 20, comprising a defrosting step g) of one or more of the at least one evaporator, said defrosting step g) being advanced or delayed depending on the level of liquid collected into the respective liquid separator of the two or more low-pressure branches.

25. The method of managing the refrigeration plant according to claim 17, wherein the refrigeration plant further comprises an electronic control unit configured to automatically manage the refrigeration plant.

26. The refrigeration plant according to claim 2, wherein said first valve being an on-off valve and said second valve being a non-return valve.

27. The refrigeration plant according to claim 5, wherein said first valve being an on-off valve and said second valve being a non-return valve.

28. The refrigeration plant according to claim 7, wherein said first valve being an on-off valve and said second valve being a non-return valve.

29. The refrigeration plant according to claim 16, wherein said devices comprise:

a regulation valve as expansion device at the inlet of the evaporator; and a pressure probe and a temperature probe placed at the evaporator outlet.

* * * * *